US009960495B1

(12) United States Patent
Hollenbeck et al.

(10) Patent No.: US 9,960,495 B1
(45) Date of Patent: May 1, 2018

(54) INTEGRATED SINGLE-PIECE ANTENNA FEED AND CIRCULAR POLARIZER

(71) Applicant: Optisys, LLC, West Jordan, UT (US)

(72) Inventors: Michael C. Hollenbeck, West Jordan, UT (US); Robert Smith, West Jordan, UT (US); Clinton Cathey, West Jordan, UT (US); Janos Opra, West Jordan, UT (US)

(73) Assignee: Optisys, LLC, West Jordan, UT (US)

( * ) Notice: Subject to any disclaimer, the term of this patent is extended or adjusted under 35 U.S.C. 154(b) by 0 days. days.

(21) Appl. No.: 15/679,137

(22) Filed: Aug. 16, 2017

Related U.S. Application Data

(63) Continuation of application No. 15/445,866, filed on Feb. 28, 2017, now Pat. No. 9,742,069.

(60) Provisional application No. 62/409,277, filed on Oct. 17, 2016.

(51) Int. Cl.

| | |
|---|---|
| ***H01Q 13/00*** | (2006.01) |
| ***H01Q 13/02*** | (2006.01) |
| ***H01Q 19/19*** | (2006.01) |
| ***H01Q 19/13*** | (2006.01) |
| ***H01Q 15/24*** | (2006.01) |
| ***H01Q 1/28*** | (2006.01) |

(52) U.S. Cl.
CPC ..... *H01Q 13/02* (2013.01); *H01Q 1/288* (2013.01); *H01Q 15/244* (2013.01); *H01Q 19/13* (2013.01); *H01Q 19/193* (2013.01)

(58) Field of Classification Search
CPC .. H01Q 13/0208; H01Q 13/02; H01Q 19/134; H01Q 19/193
See application file for complete search history.

*Primary Examiner* — Graham Smith
(74) *Attorney, Agent, or Firm* — Paul C. Oestreich; Eminent IP, P.C.

(57) ABSTRACT

Embodiments of the invention include an integrated single-piece antenna feed and a turnstile circular polarizer suitable for use in a satellite communications system. One embodiment of the integrated single-piece antenna includes a circular waveguide input, a turnstile, a coaxial feed horn, subreflector and subreflector support. One embodiment of the turnstile features four branches of wrapped-single-ridged waveguide. Another embodiment is a turnstile circular polarizer.

20 Claims, 24 Drawing Sheets
(22 of 24 Drawing Sheet(s) Filed in Color)

INTEGRATED SINGLE-PIECE ANTENNA FEED AND CIRCULAR POLARIZER

CROSS-REFERENCE TO RELATED APPLICATIONS

This US continuation patent application claims benefit and priority to U.S. non-provisional patent application Ser. No. 15/445,866, filed on Feb. 28, 2017, titled "INTEGRATED SINGLE-PIECE ANTENNA FEED", issued as U.S. Pat. No. 9,742,069 on Aug. 22, 2017, which in turn claims benefit and priority to U.S. provisional patent application No. 62/409,277 filed on Oct. 17, 2016, titled "INTEGRATED SINGLE-PIECE ANTENNA FEED", the contents of both of which are incorporated by reference as if fully set forth herein.

BACKGROUND OF THE INVENTION

Field of the Invention

The present invention relates generally to antennas and feeds for dish antennas. In particular, this invention relates to ring focus dish antennas for use in communications systems. Still more particularly, this invention relates to an integrated antenna feed and a turnstile circular polarizer for use with a ring focus dish antenna.

Description of Related Art

High gain antennas, used in applications such as satellite communications (SATCOM), or long range line-of-sight (LOS) communications links, require large aperture areas to achieve sufficiently high gains. Two primary methods by which these large aperture areas can be achieved are through an array of small elements (array antenna) or through directing the RF energy to an antenna feed using a large area dish and a subreflector. The reflector may also focus directly to an antenna feed (primary feed reflector) instead of using a subreflector. The reflector can be fabricated in a plurality of ways to achieve the optics desired. Additionally, a large lens can be used to focus energy to an antenna feed.

In parabolic antennas such as satellite dishes, an antenna feed horn (or feedhorn) is a small horn antenna used to direct radio waves between a feedhorn, a subreflector, and a parabolic main reflector dish. The antenna can be transmit only, receive only (half duplex), or it can have both transmit and receive functionality, simultaneously (full duplex). In transmit mode, the feed horn is connected to the transmitter and converts the radio frequency energy from the transmitter to radio waves and feeds them to the rest of the antenna, which focuses them into a beam. In receiving mode, incoming radio waves are gathered and focused by the antenna's main reflector onto the feed horn, which converts the incoming radio waves into detectable radio frequency energy which may be amplified and further processed by the receiver. Transmission mode and receiving mode can occur simultaneously from the same antenna either through frequency division or through time division duplexing. Alternatively, transmission and receiving modes can occur individually.

Ideally, the aperture between the feed horn and subreflector of a ring focus reflector-type antenna is entirely unobstructed. However, in conventional reflector-type antennas, some form of mechanical structure is generally required to support the subreflector relative to the feed horn. However, such support structure, e.g., one or more struts, dielectric, etc., unavoidably shadows, attenuates, or blocks, a portion of the aperture between the feed horn and the subreflector and consequently degrades the performance of the antenna.

Another problem with a conventional antenna feed is that each of the components, e.g., input section, polarizer, feed horn and subreflector, is generally constructed as a separate component. The assembly, testing and fine tuning of such separately manufactured antenna feeds results in significant labor and manufacturing cost, long fabrication and test times, and potential for high variability of antenna performance between units.

Antennas located in space on a satellite are limited in material choices, and most dielectrics are not fit for space applications. Similarly, the use of struts degrades performance and increases the stowed size of the antenna, making it more difficult and expensive to launch.

Accordingly, there exists a need in the art for a high-gain antenna feed that alleviates at least some of these problems with conventional antenna feeds used with ring focus dish reflector-type antenna systems. For example, an antenna feed without dielectric or strut supports would be particularly useful in the SATCOM context.

SUMMARY OF THE INVENTION

An embodiment of an integrated antenna feed having an axis with proximal and distal ends for propagating an electromagnetic wave is disclosed. The antenna feed may include a circular waveguide input having a circular opening at the proximal end and extending coaxially toward the distal end. The antenna feed may further include a circular waveguide to wrapped-single-ridged waveguide transition coupled to the circular waveguide input and extending further along the axis toward the distal end and flaring radially outward relative to the axis into four waveguide branches. The antenna feed may further include a polarizer coupled to the four branches of the circular waveguide to wrapped-single-ridged waveguide transition, wherein each of the four branches forms a wrapped-single-ridged waveguide extending from the circular waveguide to wrapped-single-ridged waveguide transition and parallel to the axis further toward the distal end. The antenna feed may further include a wrapped-single-ridged waveguide to coaxial waveguide transition coupled to the polarizer and each of the four branches transitioning into a single coaxial waveguide. The antenna feed may further include a coaxial feed horn coupled to the single coaxial waveguide of the wrapped-single-ridged to coaxial waveguide transition, the single coaxial waveguide disposed between an inner cylindrical support having a smaller diameter and a feed horn bell having a larger and variably increasing diameter opening to free space, the inner cylindrical support extending coaxially from the feed horn still further toward the distal end. The antenna feed may further include a subreflector located at the distal end and supported by the inner cylindrical support.

An embodiment of a turnstile polarizer disposed between a circular waveguide input and coaxial feed horn is disclosed. The polarizer may include two wrapped-single-ridged positive phase-shift waveguides, each positive phase-shift waveguide having first and second ends. The polarizer may further include two wrapped-single-ridged negative phase-shift waveguides having third and fourth ends. The polarizer may further include a first transition in communication with the circular waveguide input and the first ends of the two wrapped-single-ridged positive phase-shift waveguides, the first transition also in communication with the third ends of the two wrapped-single-ridged negative phase-shift waveguides. The polarizer may further include a second transition in communication with the coaxial feed horn and the second ends of the two wrapped-single-ridged positive phase-shift waveguides, the second transition also in communication with the fourth ends of the two wrapped-single-ridged negative phase-shift waveguides.

Additional features and advantages of the invention will be apparent from the detailed description which follows, taken in conjunction with the accompanying drawings, which together illustrate, by way of example, features of embodiments of the present invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following drawings illustrate exemplary embodiments for carrying out the invention. Like reference numerals refer to like parts in different views or embodiments of the present invention in the drawings.

DETAILED DESCRIPTION

Embodiments of the present invention include an integrated single-piece antenna feed for use in communications systems such as SATCOM, or long range LOS communications links. The feed may include circular waveguide input, polarizer, coaxial feed horn with subreflector support, and subreflector as a single-piece metal component. This antenna feed may be used in conjunction with a parabolic ring-focus main reflector in a dish antenna system. A particularly useful feature of embodiments of the antenna feed is that the antenna feed is formed of an integrated "single-piece" and is not assembled from its individual components. Integrated embodiments and individual components of the invention described herein may be manufactured using three-dimensional (3D) metal printing, (also known in the industry as direct metal printing (DMP), or additive manufacturing) techniques known to one of ordinary skill in the art.

According to one embodiment, all components of various embodiments of the antenna feed and are printed as an integrated single piece of metal, e.g., aluminum. This integrated manufacturing eliminates a large number of component parts, multiple assembly steps as well as tuning steps during test.

Embodiments of the integrated single-piece antenna feed may support full duplex, i.e., both transmitting (Tx) and receiving (Rx), half duplex, Tx only, or Rx only. Accordingly, the embodiments of an antenna feed disclosed herein do not define transmit or receive functionality, as they are reciprocal and equal at that stage of an antenna system for a given frequency. The determination which Tx/Rx scheme to use for a given antenna systems happens further down the RF chain at the filtering and RF electronics stage (to determine whether duplexing happens in frequency or time, if at all).

One embodiment of the integrated antenna feed disclosed herein may be designed to work at X-band SATCOM frequencies. According to another embodiment, the integrated antenna feed can be scaled to work from low X-band (7 GHz) through E-band (90 GHz).

Figure 1:
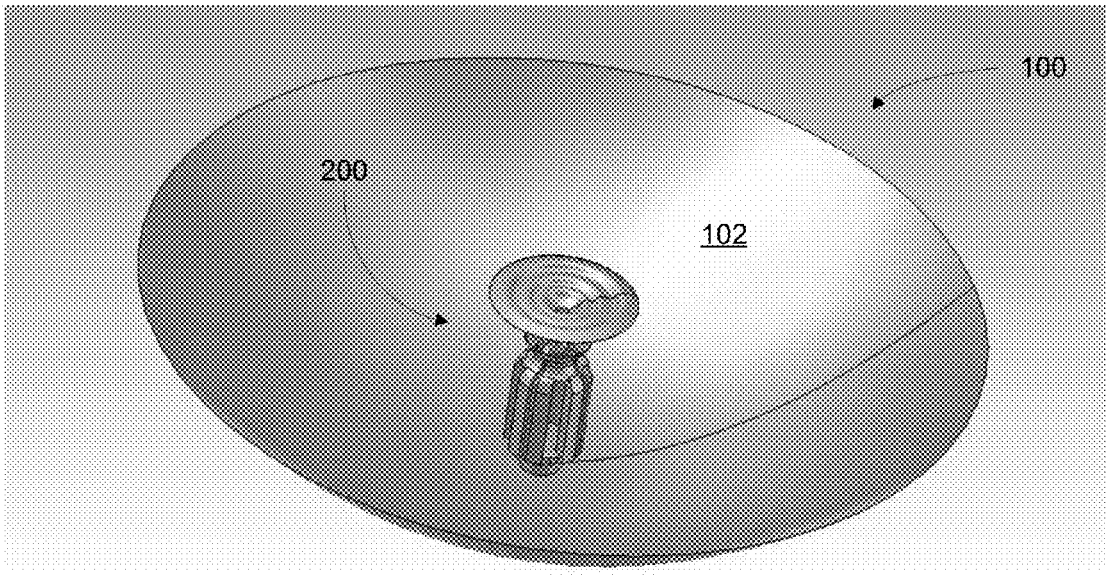
FIG. 1 is a perspective view of an embodiment of an antenna including an embodiment of an integrated antenna feed, according to the present invention.

FIG. 1 is a perspective view of an embodiment of an antenna 100 including an embodiment of an integrated antenna feed 200, according to the present invention. The antenna feed 200 is configured to be mounted to a main reflector dish 102. According to one embodiment, the main reflector dish 102 is a parabolic ring-focus reflector dish.

Figure 2A:
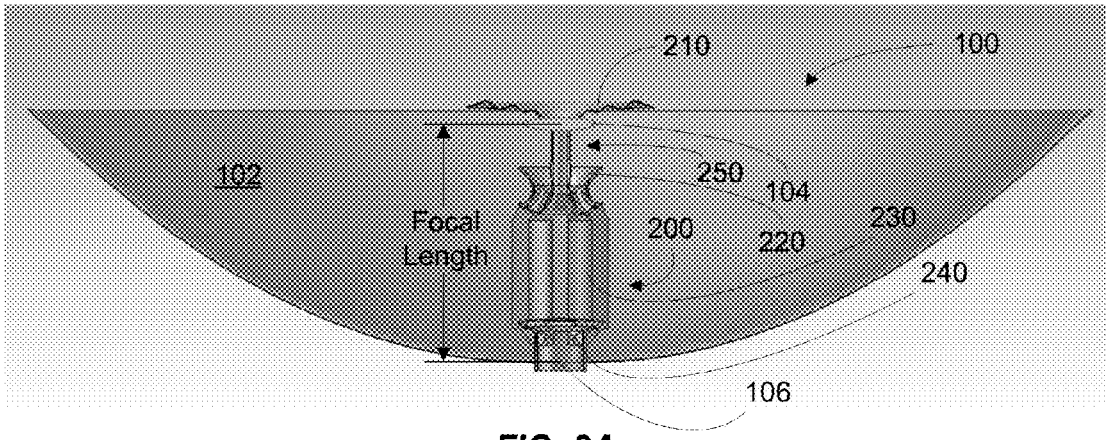
FIG. 2A is a cross-sectional view of the embodiment of an antenna with an integrated antenna feed shown in FIG. 1.

FIG. 2A is a cross-sectional view of the embodiment of an antenna 100 with an integrated antenna feed 200 shown in FIG. 1. In contrast to a conventional parabolic dish reflector, a ring-focus reflector dish does not have a single focal point, but rather a circular ring-focus that concentrates the electromagnetic wave at a preselected focal length from the apex 106 of the main reflector dish 102, see FIG. 2A. Antennas 100 according to various embodiments of the present invention may include a main reflector 102 having a ring focus 104 based on the construction of the main reflector 102. Embodiments of an antenna 100 may also include a subreflector 210 positioned near the focal ring 104 of the main reflector 102, and a feed horn 220 configured to be in the focal region of the subreflector 210. Embodiments of an antenna 100 may also include a polarizer 230.

Figure 2B:
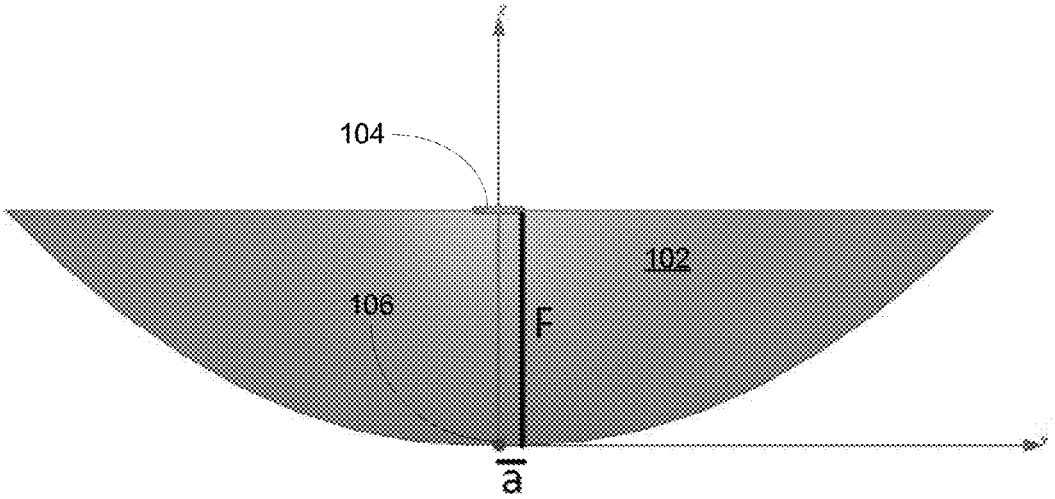
FIGS. 2B and 2C are diagrams illustrating the ring offset, a, and focal length, F for a parabolic equation for a ring-focus antenna, according to the present invention.
Figure 2C:
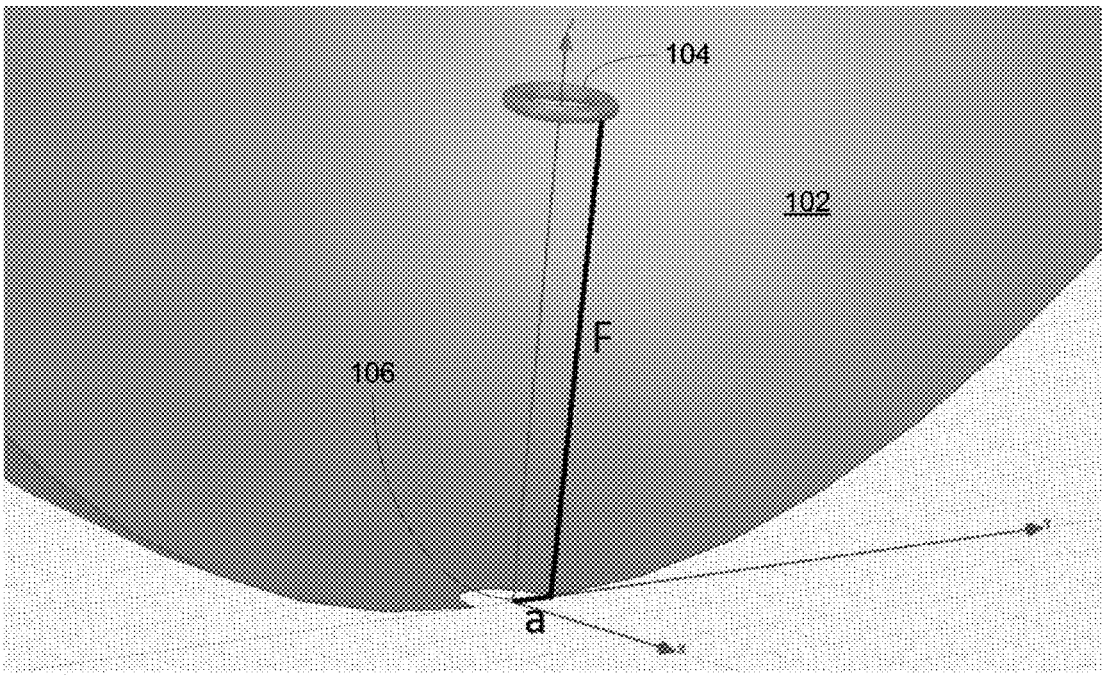

A parabolic ring-focus reflector follows the parabolic equation:

$$y = \frac{(x-a)^2}{4F}$$

where the ring offset in the parabola, a, allows for a ring-focus, and the focal length of the antenna, F, is distance from apex of the main reflector to the focal ring. FIGS. 2B and 2C are diagrams illustrating the ring offset, a, and focal length, F, for a parabolic equation for a ring-focus antenna, according to the present invention. More particularly, FIG. 2B is a side view illustrating the parameters of the parabolic equation, shown above, including the main reflector 102, ring focus 104 and main reflector apex 106. FIG. 2C is a close-up perspective view illustrating the parameters of the parabolic equation, shown above, also including the main reflector 102, ring focus 104 and main reflector apex 106. FIGS. 2B and 2C show that the ring offset, a, is the radius of the ring focus 104 (depicted as a torus in FIGS. 2B and 2C).

Figure 3:
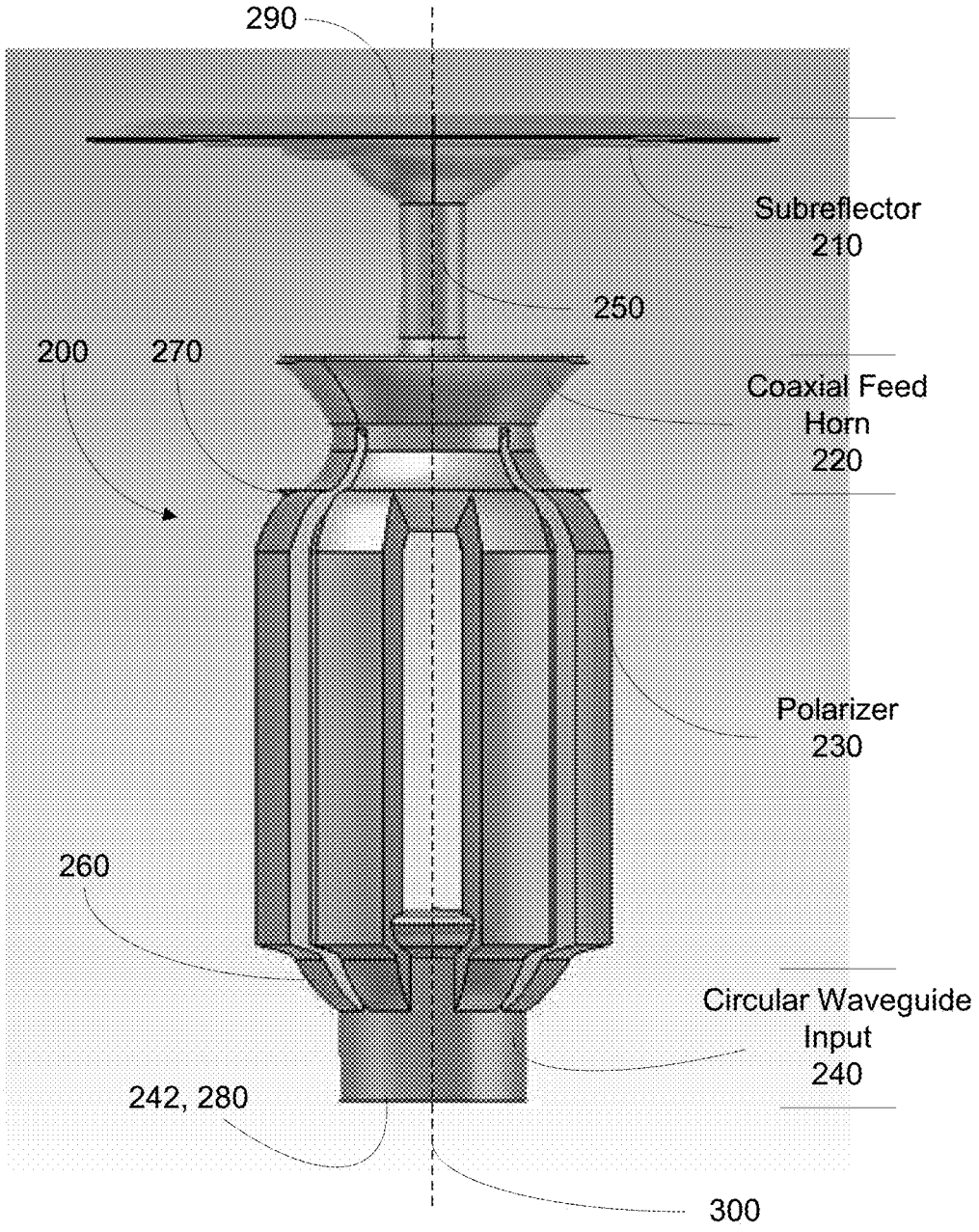
FIG. 3 is a side view of an embodiment of an integrated antenna feed, according to the present invention.

FIG. 3 is an enlarged side view of an embodiment of an integrated antenna feed 200, according to the present invention. FIG. 3 shows the relative physical locations of the various components included in the integrated antenna feed 200. Embodiments of an integrated antenna feed 200 may include many different components working together, e.g., a subreflector 210, subreflector support 250, coaxial feed horn 220, polarizer 230 and circular waveguide input 240. Conventionally, each of the waveguide components of an antenna system may each be fabricated separately, or in small combinations. However, in the preferred embodiment of the present invention, the entire antenna feed 200 may be manufactured as a single integrated structure using metal additive manufacturing or metal 3D printing, for example using aluminum. Note that subreflector support 250 may be the inner conductor of coaxial feed horn 220, according to the illustrated embodiments.

From a waveguide perspective, integrated antenna feed 200 includes a circular waveguide input 240 having a circular opening 242 at a proximal end 280. The circular waveguide input 240 leads to a circular waveguide to wrapped-single-ridged waveguide transition 260. The circular waveguide to wrapped-single-ridged waveguide transition 260 is disposed between the circular waveguide input 240 and polarizer 230. The polarizer 230 is comprised of a plurality of wrapped-single-ridged waveguide branches as discussed in more detail below. Between the coaxial feed horn 220 and the polarizer is a wrapped-single-ridged waveguide to coaxial waveguide transition 270. The coaxial feed horn 220 includes a center conductor that is also a subreflector support 250 that physically supports the subreflector 210 at the distal end of antenna feed 200.

Figure 4A:
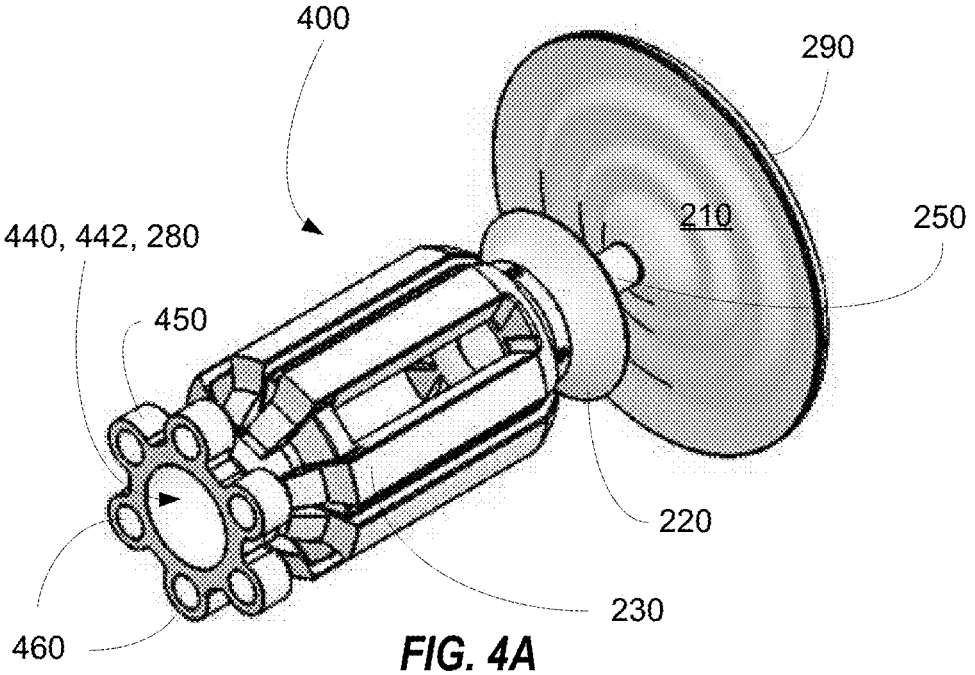
FIGS. 4A and 4B are perspective solid structure and wire-frame views of another embodiment of an integrated antenna feed, according to the present invention.
Figure 4B:
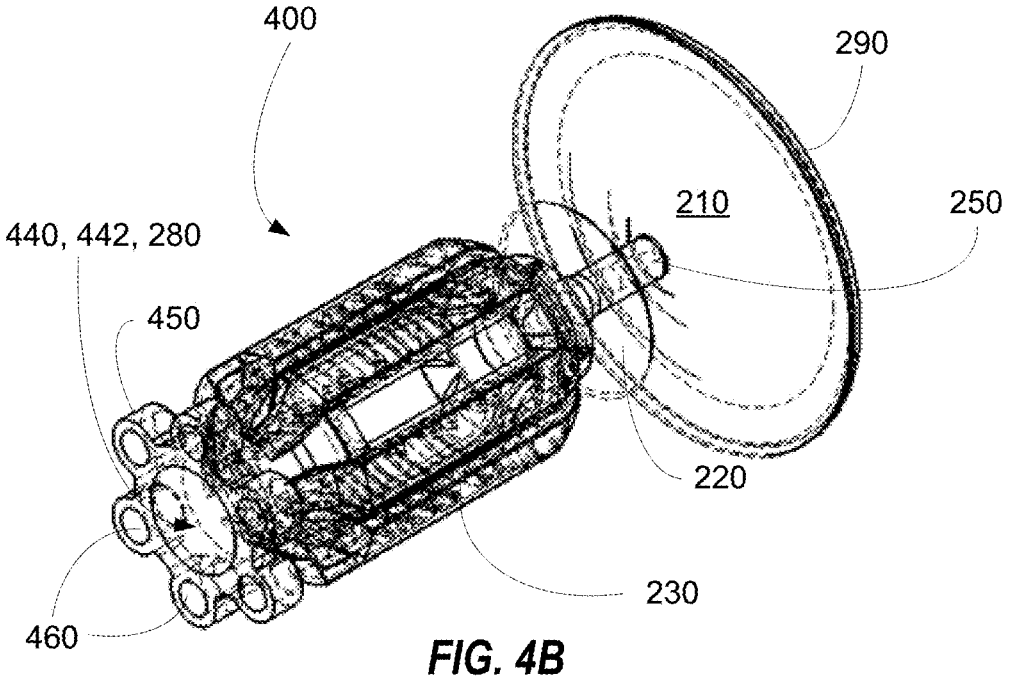
Figure 5:
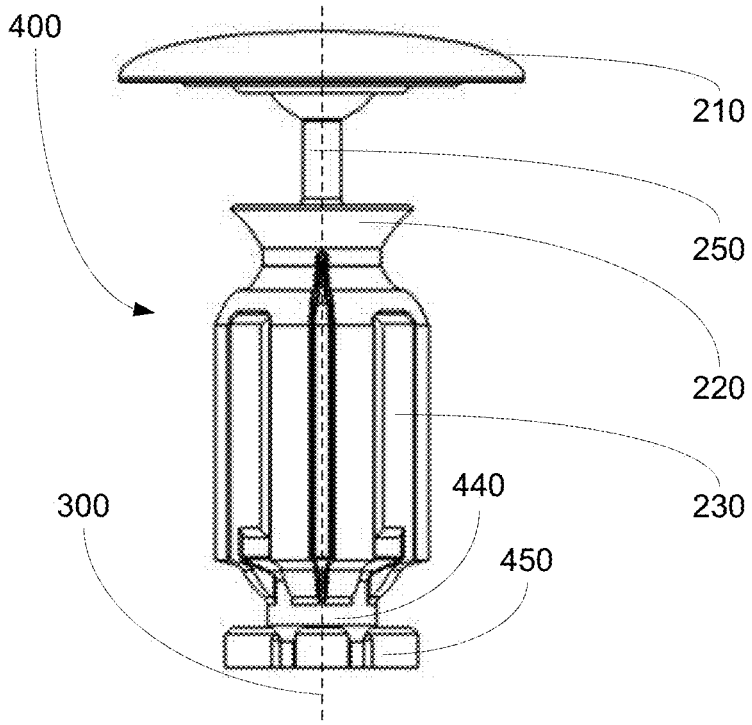
FIG. 5 is a side view of the embodiment of an integrated antenna feed shown in FIGS. 4A and 4B.
Figure 6:
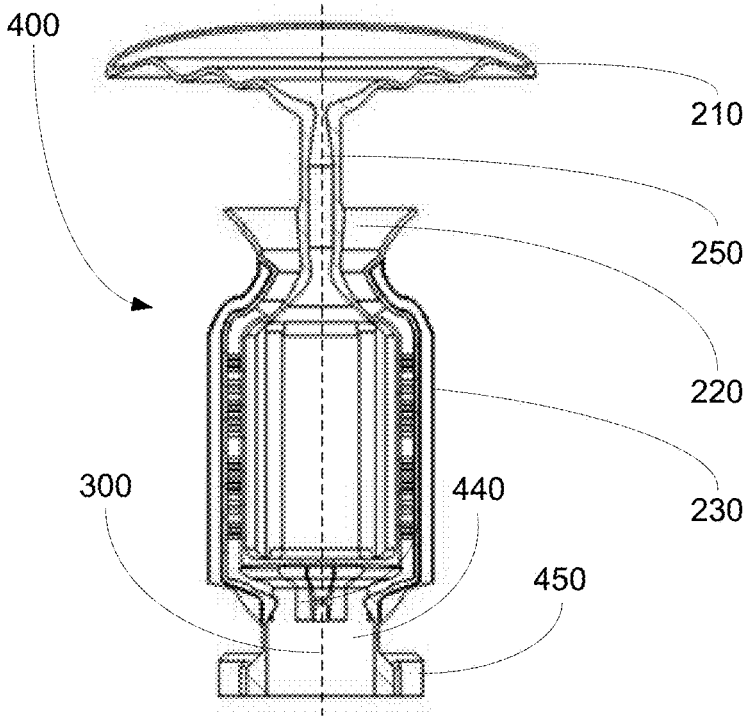
FIG. 6 is cross-sectional view through the positive phase-shifting arms located in the short walls (wall/wall) of the waveguide, according to the embodiment of the present invention shown in FIGS. 1-5.
Figure 7:
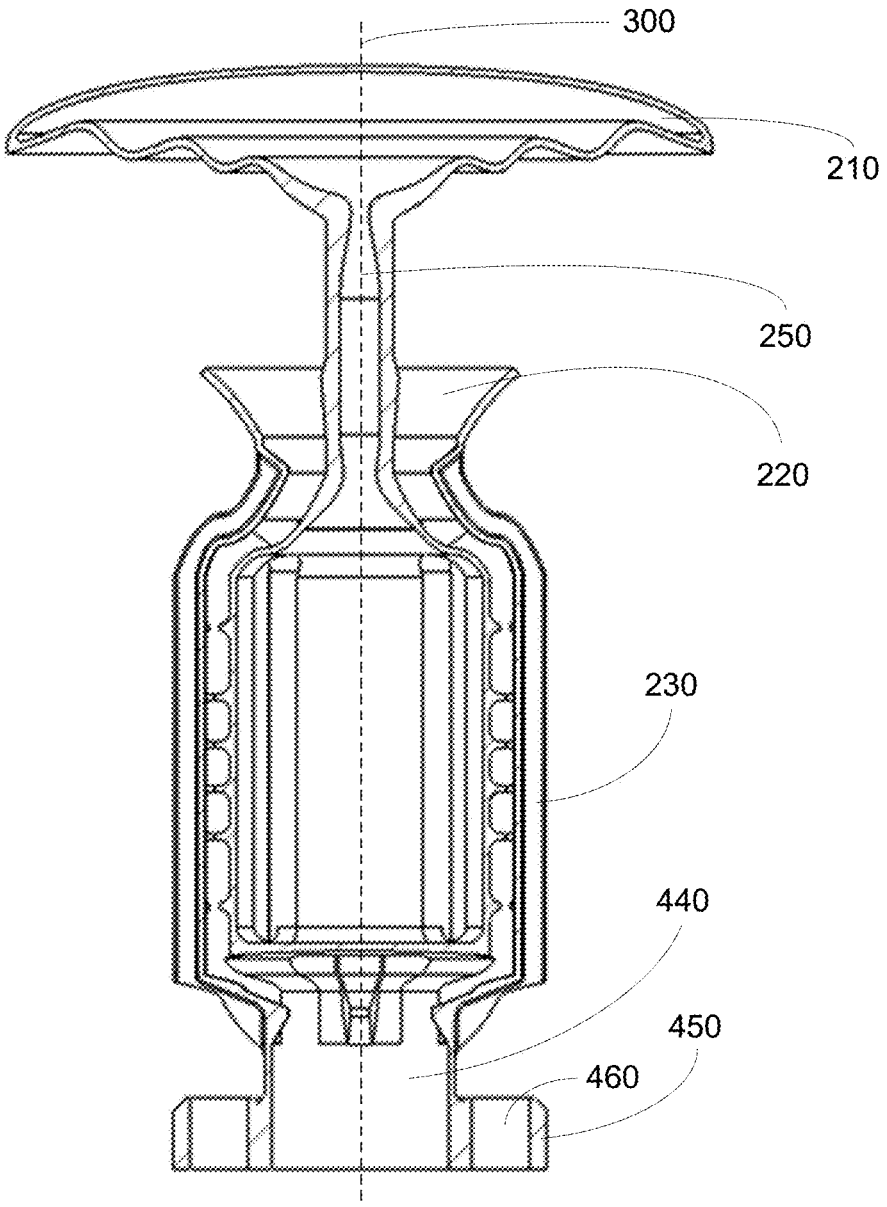
FIG. 7 is cross-sectional view through the negative phase-shifting arms located in the long walls (ceiling/floor) of the waveguide, according to the embodiment of the present invention shown in FIGS. 1-6.

FIGS. 4A and 4B are perspective solid structure and wire-frame views of another embodiment of an integrated antenna feed 400, according to the present invention. As shown in FIG. 4A, the circular waveguide input 440 (left side) transitions into the four equally-spaced waveguide branches of the circular polarizer 230. The branches have internal phase-shifting arms that recombine the electromagnetic wave into a coaxial feed horn 220 that feeds the subreflector 210. A cylindrical support structure 250 supports the subreflector 210 at the appropriate distance from the feed horn 220. Antenna feed 400 may be entirely fabricated as a single piece of metal, according to one embodiment of the invention. Note that antenna feed 400 is similar to antenna feed 200 shown in FIGS. 1-3 except that the circular waveguide input 440 is constructed with a flange 450, which may include a plurality of mounting holes 460 (six shown) used with appropriate mounting hardware (nuts and bolts, or screws and threaded inserts none shown) to attach the antenna feed 400 to a main reflector dish such as 102 shown in FIG. 1.

Ideally, there is free space between the subreflector and feed horn in a ring-focus reflector antenna. Fabricating the subreflector and feed horn as separate components allows the subreflector and feed horn to be physically separated in such a way the RF energy can properly radiate from the feed horn and bounce off the subreflector. A subreflector support is generally necessary: (1) to position the subreflector at the correct location with respect to the feed horn and the main reflector and (2) to physically support the subreflector in that desired location under a variety of shock and vibration conditions.

However, externally mounted electrically conductive supports (not shown) cause blockage to the main radio frequency (RF) path between the subreflector and feed horn, causing significant degradation of antenna performance. Such conventional subreflector supports (not shown) may include struts, dielectric supports, and other methods that use individual or multiple support structures to hold the subreflector in place. All of these conventional subreflector supports tend to degrade antenna system performance. Another drawback with conventional antenna systems is that using separately fabricated components that are assembled together requires precision assembly followed by tuning of the antenna after fabrication to ensure proper positioning of the subreflector. Yet another design consideration is that extra weight may be added to the antenna feed design by the subreflector support, which is undesirable in some antenna applications.

A particularly useful feature of the present invention is that it solves the problem of subreflector support and multipiece construction by employing a subreflector support 250 extending from the center conductor of the coaxial feed horn 220 to physically support the subreflector 210 with a turnstile polarizer 230. One embodiment of the invention is an integrated antenna feed 200, 400 for use with a main reflector dish 102 in an antenna system 100. The integrated antenna feed 200, 400 may include a subreflector 210 at a distal end 290, supported by a subreflector support 250 extending from a coaxial feed horn 220, a coaxial-to-circular turnstile polarizer 230, and circular waveguide input 240, 440 having a circular opening 242, 442 located at a proximal end 280 of the antenna feed 200, 400. Embodiments of an antenna feed 200, 400 may be fabricated as an integrated metal construct, for example by using three dimensional (3D) metal printing techniques. By using 3D metal printing techniques, separate mounting hardware and related tuning of individual components are both eliminated because the components share structural walls at their interfaces. Additional support structure may be added to strengthen the antenna feed, according to other embodiments. At least one embodiment of an integrated antenna feed may be used in conjunction with a main reflector that has a ring focus, see e.g., 100, FIGS. 1 and 2.

According to one embodiment, the subreflector may be an optimized surface that is radially symmetric about the main axis (see 300, FIG. 3) of the coaxial subreflector support 250 extending between the subreflector 210 and the feed horn 220. The coaxial subreflector support 250 may be constructed as an extended feature of the coaxial feed horn 220. This coaxial subreflector support 250 provides at least two functions: (1) it structurally supports the subreflector 210 and (2) it forms an inner conductor, or coaxial waveguide inner cylindrical surface, within the feed horn 220.

One embodiment of an antenna waveguide polarizer may be used to synthesize circular polarization by converting a single-mode input from the circular waveguide input 240 into two orthogonal degenerate primary coaxial waveguide transverse electric (TE) modes and phase-shift them 90° with respect to one another. By doing this, both right-hand circular polarization (RHCP) and left-hand circular polarization (LHCP) can be achieved by phase-shifting one mode by positive or negative 90° with respect to the other. Various embodiments of waveguide circular polarizers are contemplated to be within the scope of the present invention, including; septums, dielectric wedges, corrugated waveguide, and other approaches known to those of ordinary skill in the art.

More particularly, embodiments of the antenna feed 200 and 400 disclosed herein employ $TE_{11}$ mode in the circular waveguide input 240 and $TE_{11}$ in the coaxial feed horn 220. Both $TE_{11}$ modes (circular waveguide and coaxial waveguide), have "degenerate modes", which simply means you can orient the field in more than one orientation in the waveguide and the modes will have the same cutoff frequency, impedance characteristics, and TE numbering designation, but they are orthogonal. For the $TE_{11}$ mode (circular waveguide and coaxial waveguide) there are two degenerate orthogonal modes.

According to another embodiment, the feed horn may be a coaxial feed horn that transitions to a coaxial turnstile polarizer with four branches of wrapped-single-ridged waveguide. The four branches of wrapped-single-ridged waveguide act as a polarizer to convert a linearly polarized input to a circularly polarized output when transmitting and vice versa when receiving. The four branches of wrapped-single-ridged waveguide may include two pairs of wrapped-single-ridged waveguides, one pair with a +45° phase-shift and one pair with a −45° phase-shift, according to a particular embodiment of the invention.

More particularly, the net 90° phase shift is achieved by matching the slopes of the positive and negative phase shift branches 730P and 730N, where the +45° and −45° happens at only one part of the band, but there is an effectively linear phase relation with frequency. So, the term "+45° phase shift" as used herein is actually +45° at one point or frequency in the frequency band of operation. Likewise the term "−45° phase shift", similarly, is at one point in the frequency band of operation. The positive phase shift arms 730P have a linear phase-shift relationship over frequency band with some slope '+m'. The negative phase shift arms 730N have a linear phase-shift relationship over frequency with a slope of approximately '−m'. This leads to an effective phase shift of 90° between the branches 730P and 730N over a wide bandwidth, since the +m slope is cancelled out by the −m slope to achieve a flat phase-shift response over the frequency band.

The +45° phase-shift waveguide branches 730P are opposite one another, and rotated physically 90° about the main axis 300 with respect to the −45° phase-shift waveguide branches 730N. The four waveguide branches (2 pairs of phase-shifting waveguide, 730P and 730N) recombine at a circular waveguide to wrapped-single-ridged waveguide transition 260, according to this particular embodiment.

According to one embodiment, the entire feed may be physically rotated 45° about the center of the coax such that the pairs of phase-shifting waveguide are aligned with the +/−45° axes of the reflector. When fed with a linear Horizontal (H) or Vertical (V) polarized signal (oriented at 0° or 90° with respect to the rotation axis of the reflector) a circular polarization (CP) is achieved, with an input of H being converted into an output of either right hand circular polarization (RHCP) or left hand circular polarization (LHCP) and an input of V being converted into an output of the orthogonal polarization (LHCP or RHCP), depending on the orientation of the positive and negative 45° phase-shift waveguide pair.

The positive and negative 45° phase-shift in the pairs of waveguide branches may be achieved through the use of ridges in either the ceiling/floor (negative phase-shift) or the wall/wall (positive phase-shift) of the waveguide channels. This embodiment replaces use of a conventional polarizer and provides a broad bandwidth overall 90° phase-shift between the branches and synthesizes circular polarization at the coaxial feed horn. According to one embodiment, the waveguide branches are wrapped-single-ridged waveguide, with a single ridge along one wall of the waveguide. This reduces the total width of the waveguide and allows for support structures between the positive and negative 45° phase-shift waveguide pairs.

According to one embodiment, the circular waveguide input allows for an interface that can accept either a V or H linearly polarized signal. To change the polarization received at the input, one simply physically rotates the feed 90°, which changes the RF path through the phase-shifting waveguide branches in a manner that switches the polarization from RHCP to LHCP or LHCP to RHCP.

Figure 8A:
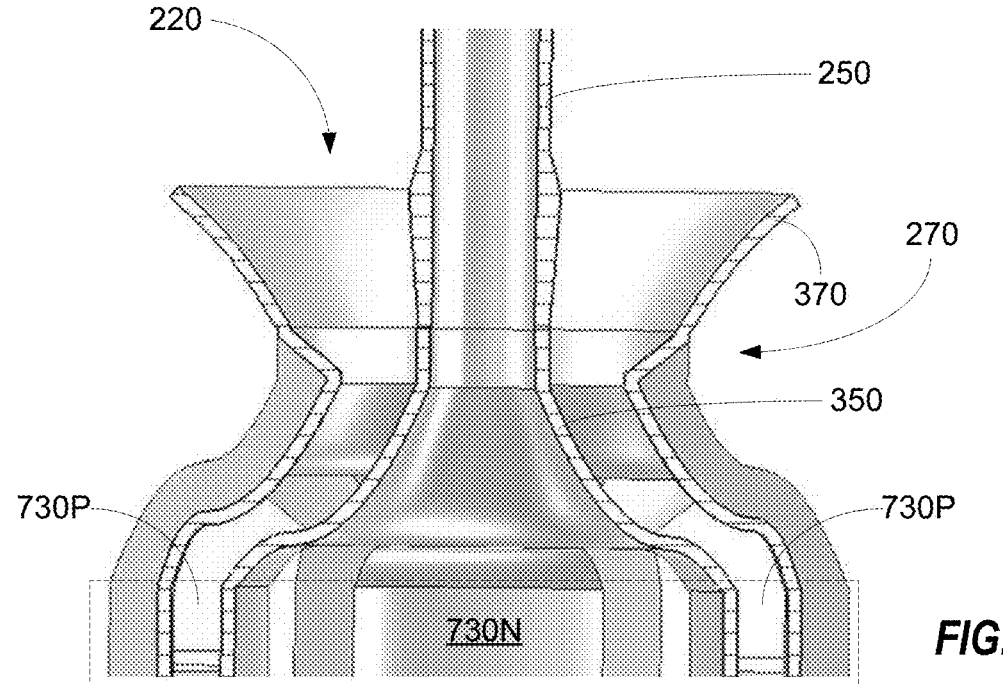
FIG. 8A is a cross-sectional view of an embodiment of the transition between the coaxial feed horn and the wrapped-single-ridged waveguide branches and of an integrated antenna feed, according to the embodiment of the present invention.

FIG. 8A is a cross-sectional view of an embodiment of the transition 270 between the coaxial feed horn, shown generally at arrow 220, and the wrapped-single-ridged waveguide branches 730P and 730N from the polarizer, shown generally in dashed line box 230 encompassing bottom of FIG. 8A and top of FIG. 8B, see more below) of an integrated antenna feed 200, 400, according to the embodiment of the present invention. As shown in FIG. 8A, the inner horn conductor 350 transitions and extends into the subreflector support 250. The outer horn conductor 370 has a bell shape, much like a trumpet horn. The subreflector 210 (not shown at the top FIG. 8) is attached to and supported by, subreflector support 250. The subreflector support 250 outer diameter acts as the inner horn conductor 370 of the coaxial feed horn 220. At the base of the coaxial feed horn (bottom of FIG. 8) the coaxial region transitions into four wrapped-single-ridged waveguide branches 730P and 730N, two positive phase-shift branches 730P are seen on the left and right of FIG. 8A, one negative phase-shift branch 730N is in the back center of FIG. 8A, and the other negative phase-shift branch 730N is opposite the illustrated back center negative phase-shift branch 730N (but, not shown in FIG. 8A due to image cut plane). The combining (or transitioning) shape of the feed horn 220 is specially designed to facilitate manufacturability via additive manufacturing (3D metal printing) without requiring structure external to the feed horn 220 for supporting the subreflector 210 (not shown).

Figure 8B:
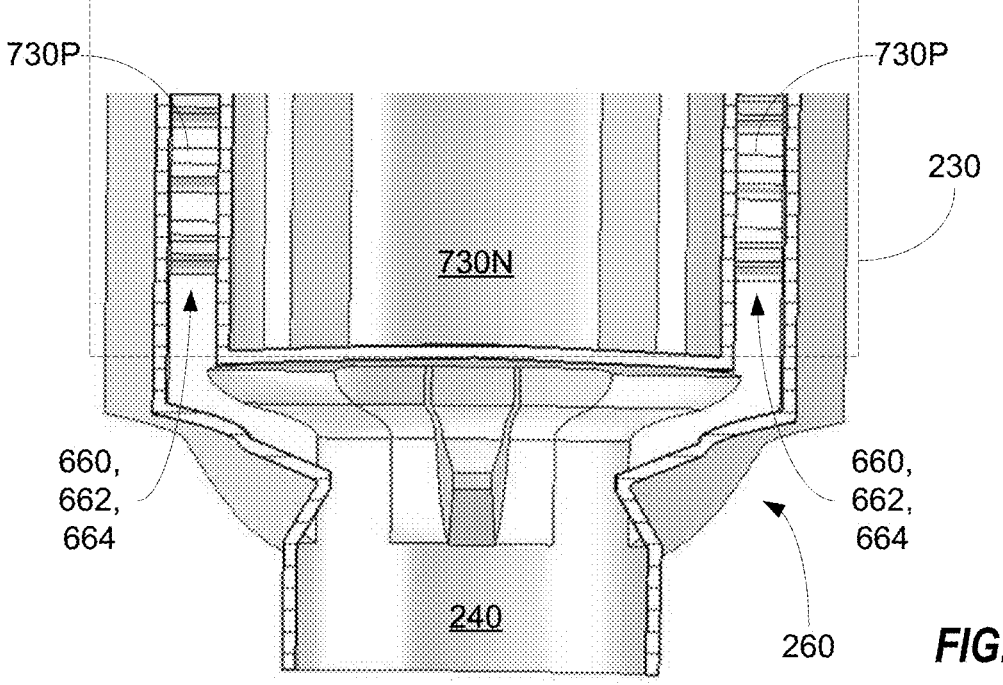
FIG. 8B is a cross-sectional view of an embodiment of the transition between wrapped-single-ridged waveguide branches of the polarizer into a circular waveguide cavity, according to the present invention.

FIG. 8B is a cross-sectional view of an embodiment of the transition 260 between wrapped-single-ridged waveguide branches 730P and 730N of the polarizer 230 (dashed line box, bottom of FIG. 8A and top of FIG. 8B) into a circular waveguide cavity 240, according to the present invention. The four incoming wrapped-single-ridged waveguide branches 730P and 730N (top of picture, one 730N not shown due to cut plane of FIG. 8B) combine into a circular waveguide input 240 at the bottom of FIG. 8B. The combining shape of transition 260 is specially designed to facilitate manufacturability via additive manufacturing without requiring supports internal to the structure. FIG. 8B also illustrates inductive rib pairs, shown generally at arrows 660, 662 and 664, within the positive phase-shift waveguide branches 730P as further discussed below with regard to FIG. 9 and FIGS. 12A and 12B.

Figure 9:
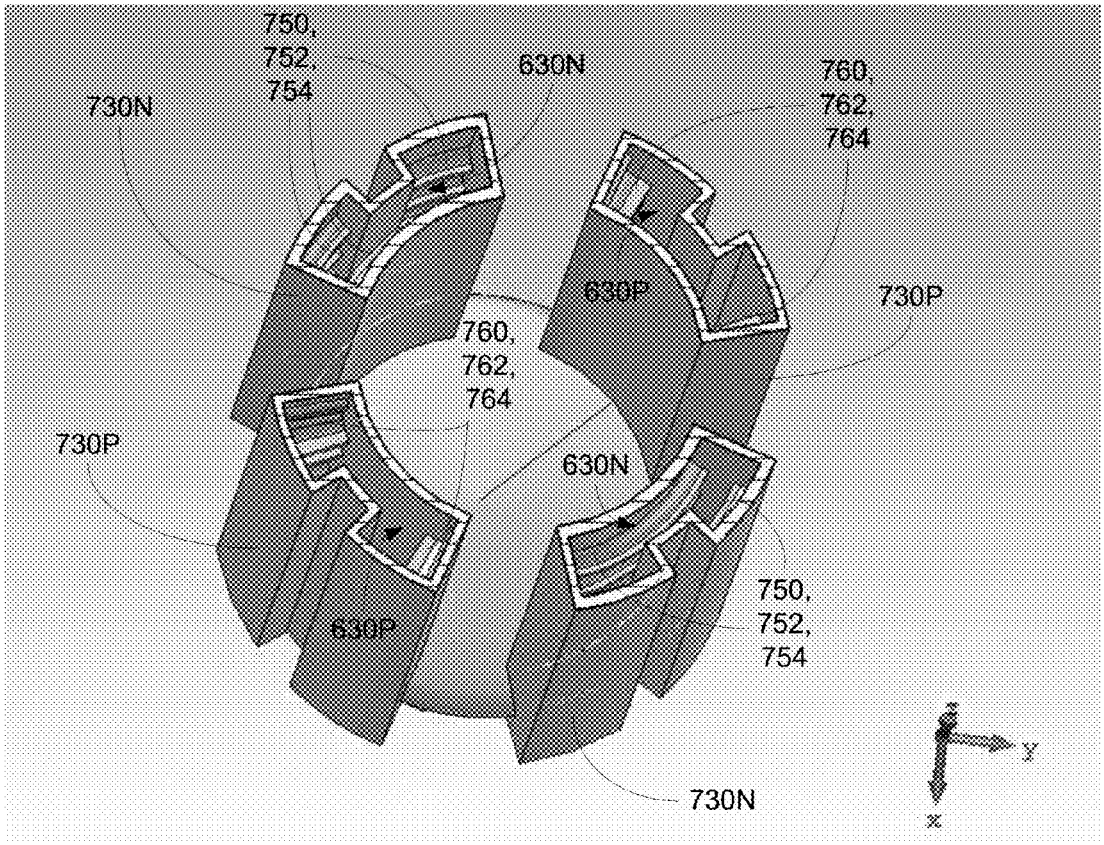
FIG. 9 is an illustration of a cross-section through an embodiment of a polarizer and its four waveguide branches showing internal features, according to the present invention.

FIG. 9 is an illustration of a cross-section through a portion of an embodiment of a polarizer 230 and its four waveguide branches 730P and 730N with internal features, according to the present invention. The two positive phase-shift waveguide branches 730P are shown opposite each other relative to the main axis 300 (see FIG. 3). Likewise the two negative phase-shift waveguide branches 730N are shown opposite each other relative to the main axis 300 (see FIG. 3). The air volume 630N within the two negative phase-shift waveguide branches 730N is shown in greater detail in FIGS. 11A and 11B and related discussion below. Similarly, the air volume 630P within the two positive phase-shift waveguide branches 730P is shown in greater detail in FIGS. 12A and 12B and related discussion below. Within the positive phase-shift waveguide branches 730P, are a series of inductive rib pairs 760, 762 and 764 which form inductive irises configured to phase-shift a wave passing through by +45°. Similarly within the negative phase-shift waveguide branches 730N, are a series of capacitive rib pairs 750, 752 and 754 which form capacitive irises configured to phase-shift a wave passing through by −45°.

Referring again to FIG. 3, various primary and higher order modes of electromagnetic wave transmission are utilized in the integrated antenna feed 200, 400 from input 240, through transition 260, through the polarizer 230, through transition 270 and out through the feed horn 220. More particularly, in the integrated antenna feed 200, 400 utilizes fundamental modes in regions where only the fundamental mode is supported, and higher order modes in the transitions 260 and 270 as well as in the coaxial feed horn 220. At the circular waveguide input 240 the mode is a $TE_{11}$. This is the fundamental electromagnetic wave transmission mode in a circular waveguide. There are two orthogonal $TE_{11}$ modes supported in this section and they are rotated 90° apart.

There are several higher order modes operating within transition 260. But, the key feature of transition 260 is that it converts the $TE_{11}$ mode from the circular waveguide input 240 into the $TE_{10}$ mode (the fundamental mode) in wrapped-single ridged waveguides, which are employed in the polarizer 230 (see FIG. 8, or more particularly 730P and 730N in FIGS. 8A, 8B and 9 and corresponding air volumes 630N and 630P in FIG. 10 and as discussed below). The TE10 mode is also supported in the alternative embodiments to the wrapped-single-ridged waveguides 730P and 730N, namely, rectangular waveguide pairs 830P and 830N (FIG. 13) and single-ridged waveguide pairs 930P and 930N (see FIG. 14.)

In a rectangular or standard ridged waveguide there is only the single fundamental $TE_{10}$ mode propagating from input 240 to feed horn 220. There are a number of higher order modes appearing in the phase-shifting section of the polarizer 230, but they do not propagate down the waveguide, rather, they couple in an evanescent manner and change the shape of the propagating wave.

At transition 270 there are also a number of higher order modes coupling in an evanescent manner that change the shape of the propagating wave to allow the transition to occur before reaching the feed horn 220. In the coaxial section of the feed horn 220, more particularly right at the throat of the feed horn 220, the mode that is supported is $TE_{11}$, which is not the fundamental TEM mode for a coaxial waveguide. The fundamental TEM mode is not supported, due to the symmetry imposed by how the feed horn 220 is fed.

The coaxial feed horn 220 shown herein supports a coaxial $TE_{11}$ mode. In the $TE_{11}$ mode, the electric field lines are primarily aligned in the same direction, which is optimal for radiation from the coaxial feed horn 220. The coaxial feed horn 220 acts as a transition between the polarizer 230 on the interior of the antenna feed 200, 400, and the free space to the subreflector 210 on the exterior of the antenna feed 200, 400. The four wrapped-single-ridged waveguide branches 730P and 730N (FIGS. 8A-B) are required to properly synthesize the $TE_{11}$ mode in the antenna feed 200, 400.

Figure 10:
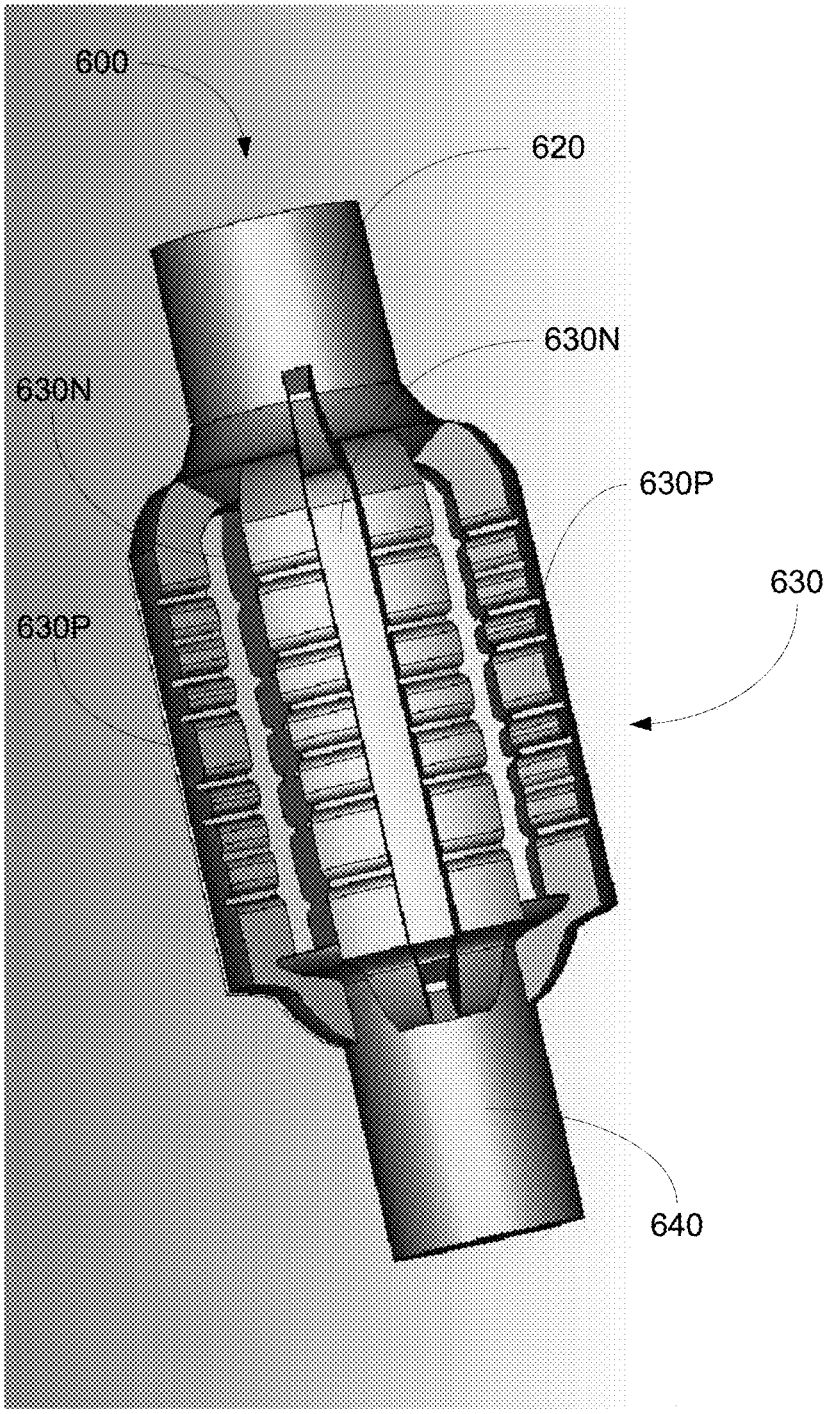
FIG. 10 is a graphical representation of the air volume within an embodiment of an integrated antenna feed, according to the present invention.

FIG. 10 is a graphical representation of the air volume 600 within an embodiment of an integrated antenna feed 200, 400, according to the present invention. More particularly, FIG. 10 illustrates the circular waveguide input air volume 640 leading up to four waveguide branches of the polarizer section, shown generally at arrow 630. The polarizer section 630 includes two positive phase-shift branches 630P (left and right sides of FIG. 10) and two negative phase-shift branches 630N (one mostly hidden by the other in the foreground of FIG. 10). The four waveguide branches 630P and 630N recombine at a coaxial section air volume 620. The throat of coaxial feed horn 220 includes the coaxial section air volume 620. Coaxial section air volume 620 represents a truncated coaxial feed horn 200, less the bell shaped outer horn conductor 370 (FIG. 8).

Figure 11A:
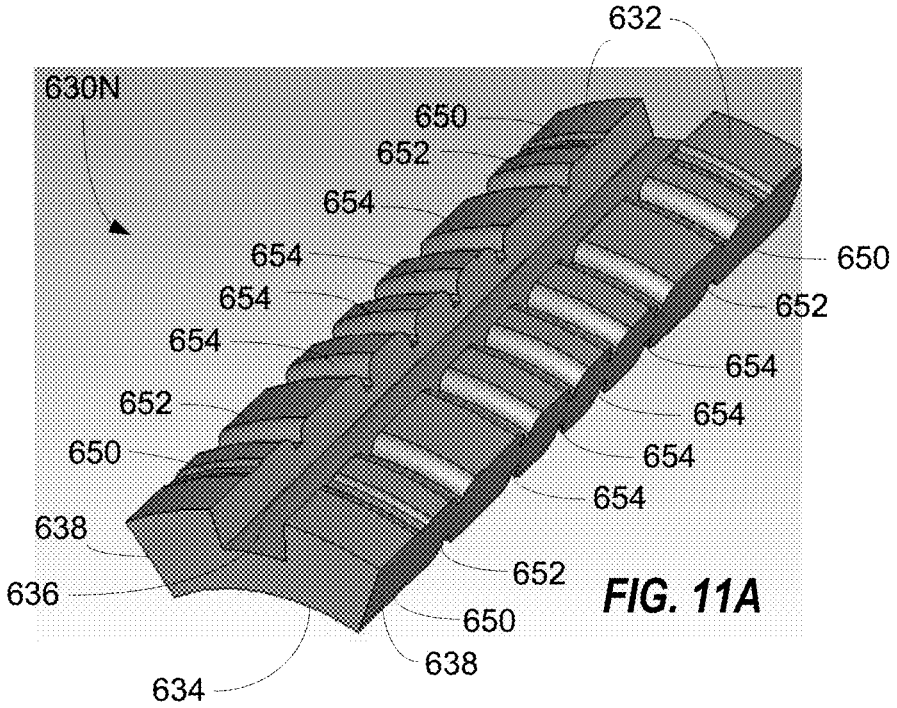
FIGS. 11A and 11B are a top and bottom perspective views of the air volume for a negative phase-shift wrapped-single-ridged waveguide branch inside an embodiment of a polarizer, according to an embodiment of the present invention.
Figure 11B:
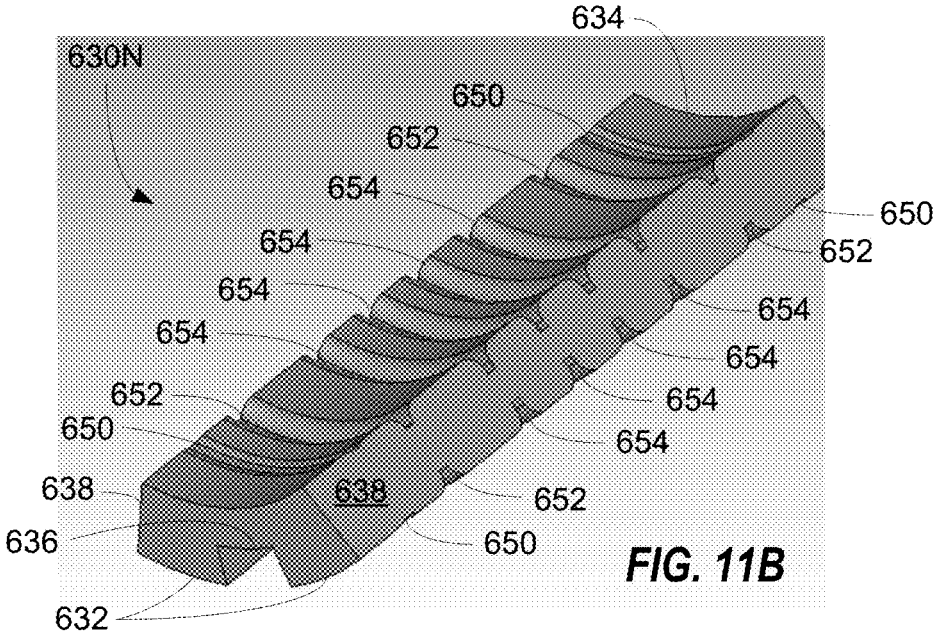

FIGS. 11A and 11B are a top and bottom perspective views of the negative phase-shift air volume 630N (or waveguide cavity) within a negative phase-shift wrapped-single-ridged waveguide branch 730N inside an embodiment of a polarizer 230 of the antenna feed 200, 400, according to the present invention. Note that air volume 630N is the waveguide cavity within branch 730N. Accordingly, the channels shown in the ceiling 632 and floor 634, extending between opposed walls 638 of air volume 630N represent matched capacitive rib pairs 650, 652 and 654 extending into the air volume 630N of the wrapped-single-ridged waveguide branch 730N. There may also be a longitudinal ridge 636 in the waveguide 630N that crosses through the ribs in the ceiling 632, as shown in the illustrated embodiment of waveguide branch 630N. In this particular embodiment of a negative phase-shift section 630N, there are eight total ribs on the ceiling 632 and eight symmetric ribs on the floor 634 of the waveguide cavity 630N, these ribs forming capacitive rib pairs 650, 652 and 654.

For this particular embodiment of a negative phase-shift waveguide cavity 630N, there are two shallow rib pairs 650, two medium depth rib pairs 652 and four deep rib pairs 654. The four deep rib pairs 654 are in the central portion of the waveguide 630N and are surrounded by the medium depth rib pairs 652 which in turn are surrounded by the shallow rib pairs 650. Stated another way, the negative phase-shift waveguide cavity 630N is symmetrical in that a wave propagating in either direction from first end to second end through the waveguide branch will be shaped identically. The negative phase-shift sections 630N are also symmetrically disposed about, and parallel to the axis 300 of the integrated antenna feed 200, 400.

The particular spacing and depth of the capacitive rib pairs 650, 652 and 654 determines the total phase-shift of the electromagnetic wave propagating through the negative phase-shift waveguide cavity 630N. The terms "waveguide cavity" and "air volume" are used synonymously herein. In the illustrated embodiment the phase-shift is −45° at a middle region of the band. The same phase-shift may be achieved with more or fewer ribs and depends on the total bandwidth desired for a 90° phase-shift, according to other embodiments of the present invention. In some embodiments of the invention, more rib pairs, e.g., twelve total capacitive rib pairs (not illustrated) on each opposed ceiling 632 and floor 634, may be used to achieve a greater bandwidth performance for a total 90° phase-shift between the positive 630P and negative 630N phase-shift arms. According to some embodiments of the negative phase-shift waveguide cavity 630N, a radius may be added to the internal corners of the individual ribs for improved manufacturability and performance. In the illustrated embodiments, the air volumes 630P and 630N are wrapped (curved around the axis on both floor and ceiling) to conform to an outer cylindrical diameter of the antenna feed 200, 400. The illustrated embodiments of negative phase-shift air volume 630N are also "ridged" in that there is a longitudinal ridge 636 bisecting the ceiling 632.

Figure 12A:
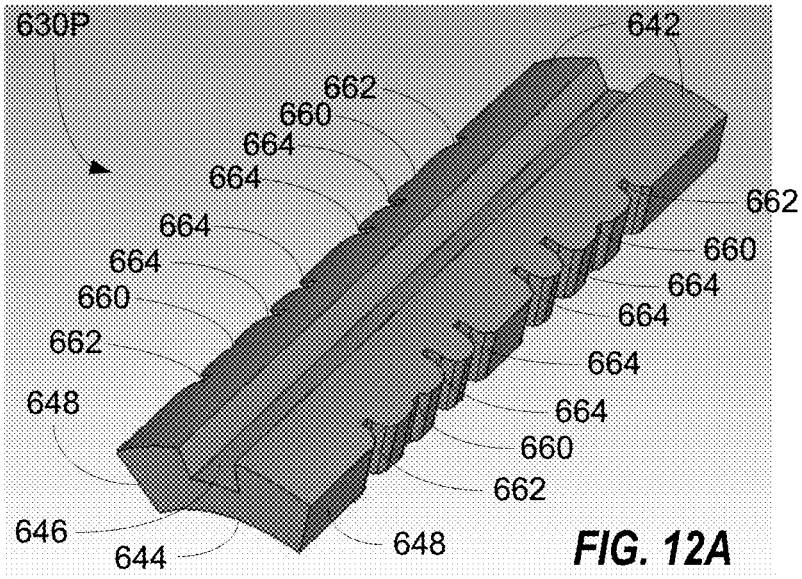
FIGS. 12A and 12B are a top and bottom perspective views of the air volume for a positive phase-shift wrapped-single-ridged waveguide branch inside an embodiment of a polarizer according to an embodiment of the present invention.
Figure 12B:
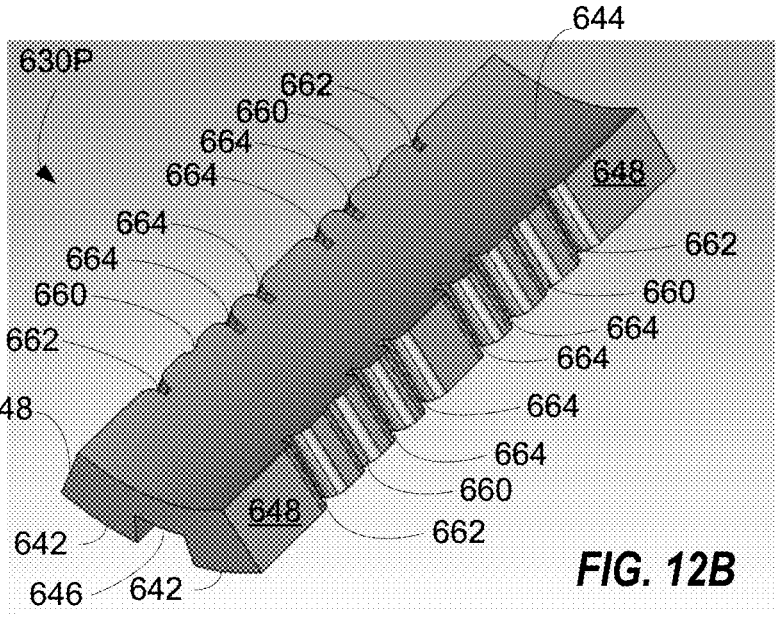

FIGS. 12A and 12B are a top and bottom perspective views of the positive phase-shift air volume 630P for a positive phase-shift wrapped-single-ridged waveguide branch 730P inside a polarizer 230 according to an embodiment of the present invention. Note that air volume 630P is the waveguide cavity within each branch 730P. Accordingly, the channels shown in the opposed walls 648, extending between ceiling 642 and floor 644 of air volume 630P represent matched inductive rib pairs 660, 662 and 664 extending into the air volume 630P of the wrapped-single-ridged waveguide branch 730P.

A wave propagating through the positive phase-shift waveguide branch 630P is bounded by floor 644 and ceiling 642 and opposed walls 648. The floor 644 runs parallel to axis 300 (see, e.g., FIG. 3). The ceiling 642 also runs parallel to the axis 300, but further away than floor 644. As shown in FIGS. 12A and 12B, there are 8 inductive rib pairs 650, 652 and 654 on each of the opposed walls 648 of the positive phase-shift waveguide branch 630P. The illustrated embodiment of positive phase-shift waveguide branch 630P includes a longitudinal ridge 646 bisecting ceiling 642. The illustrated embodiment of a positive phase-shift waveguide arm 630P is also "ridged" in that there is a longitudinal ridge 646 bisecting the ceiling 642.

For this particular embodiment of a positive phase-shift waveguide cavity 630P, there are two shallow rib pairs 660, two medium depth rib pairs 662 and four deep rib pairs 664.

The four deep rib pairs 664 are in the central portion of the waveguide 730P (air volume 630P within 730P shown in FIGS. 12A and 12B) and are surrounded by the shallow rib pairs 660 which in turn are surrounded by the medium depth rib pairs 662. Stated another way, the positive phase-shift waveguide cavity 630P is symmetrical in that a wave propagating in either direction from end to end through the waveguide branch 730P will be shaped identically. The positive phase-shift sections 630P are also symmetrically disposed about, and parallel to the axis 300 of the integrated antenna feed 200, 400.

Again, the particular spacing and depth of the inductive rib pairs 660, 662 and 664 determines the total phase-shift of the wave through the positive phase-shift waveguide branch 630P. In the illustrated embodiment the phase-shift is +45° at a middle region of the band. Again, the same phase-shift may be achieved with more or fewer ribs, and depends on the total bandwidth desired for a 90° phase-shift, according to other embodiments of the present invention. In some versions of the invention, more rib pairs, e.g., twelve total ribs on each opposed side 638, may be used to achieve a greater bandwidth performance for a total 90° phase-shift between the positive phase-shift arms 630P. The longitudinal ridge 646 in the positive phase-shift waveguide branch 630P does not cross through the inductive rib pairs 660, 662 and 664 in the opposed walls 648. A radius may be added to the internal corners of the individual ribs for improved manufacturability and performance, according to other embodiments of the present invention. The positive phase-shift waveguide branch 630P illustrated in FIGS. 12A and 12B is also wrapped (curved rather than rectangular in cross-section) to conform to an outer cylindrical diameter of the antenna feed 200, 400.

An electromagnetic wave propagating through each of the negative phase shift branches 630N of the polarizer 230 is delayed using a set of capacitive irises formed by the series of capacitive rib pairs 650, 652 and 654 located on the ceiling 632 and floor 634. This electromagnetic wave delay (negative phase-shift) is coupled with the advance of the electromagnetic wave (positive phase-shift) in a positive phase-shift branches 630P using a series of inductive irises formed by the inductive rib pairs 660, 662 and 664 in order to achieve a net 90° phase shift that is broadband enough for the band of interest, e.g., X-band for SATCOM. There are suitable alternative configurations or embodiments of positive and negative phase-shift arms that are not wrapped and have a more rectangular geometry that may be used to achieve the same phase-shifting purpose as those illustrated in FIGS. 11A, 11B, 12A and 12B, see FIGS. 13 and 14 and discussion below.

Figure 13:
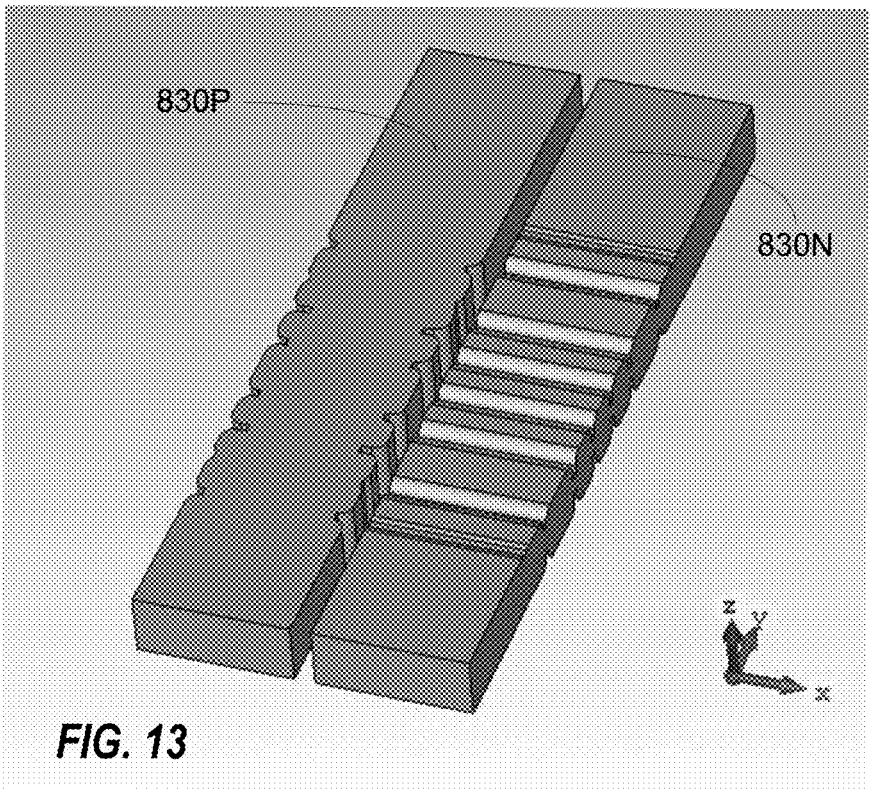
FIG. 13 is a perspective view of alternative embodiments of positive and negative phase-shift rectangular waveguides suitable for use in a polarizer for an integrated single-piece antenna feed, according to the present invention.

FIG. 13 is a perspective view of alternative embodiments of positive 830P and negative 830N phase-shift air volumes of rectangular waveguides (not shown but that would surround air volumes 830P and 830N) suitable for use in an alternative embodiment of a polarizer (not shown) for an alternative embodiment of an integrated single-piece antenna feed (also not shown), according to the present invention. Note that only two representative air volumes 830P and 830N of the four total branches (two each of 830P and 830N) are shown. Note also that the waveguide air volumes illustrated in FIG. 13 are not "wrapped" or curved like those illustrated in FIGS. 11A, 11B, 12A and 12B. Note further that the waveguide air volumes illustrated in FIG. 13 are also not ridged like those illustrated in FIGS. 11A, 11B, 12A and 12B. Accordingly, an alternative embodiment of a polarizer may be formed by replacing the wrapped-single-ridged waveguide branches 730P and 730N with equivalent waveguides having air volumes 830P and 830N shown in FIG. 13.

Figure 14:
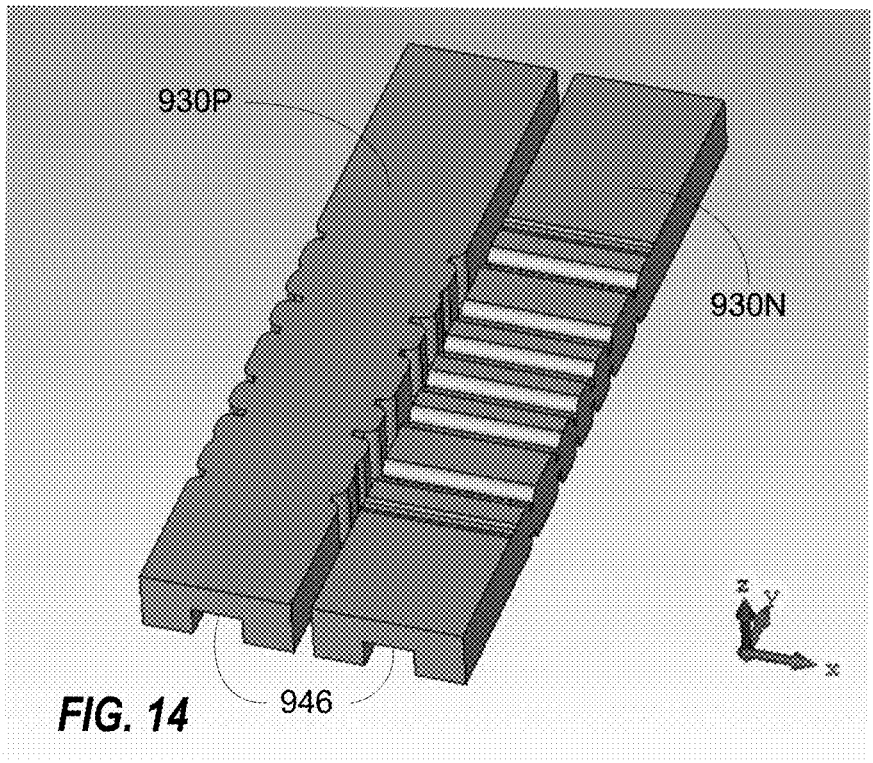
FIG. 14 is a perspective view of yet another alternative embodiment of positive and negative phase-shift ridged waveguides suitable for use in a polarizer for an integrated single-piece antenna feed, according to the present invention.

FIG. 14 is a perspective view of yet another alternative embodiment of positive 930P and negative 930N phase-shift air volumes of alternative embodiments of single-ridged waveguides, not shown, but suitable for use in an alternative polarizer (also not shown) for an alternative integrated single-piece antenna feed (also not shown), according to the present invention. Note that only two representative air volumes 930P and 930N of the four necessary polarizer branches are shown. Note further that the air volumes illustrated in FIG. 14 are not "wrapped" or curved like those illustrated in FIGS. 11A, 11B, 12A and 12B. However, the waveguides illustrated in FIG. 14 are ridged 946 like those illustrated in FIGS. 11A, 11B, 12A and 12B. Accordingly, another alternative embodiment of a polarizer may be formed by replacing the wrapped-single-ridged waveguide branches 730P and 730N with equivalent waveguides having air volumes 930P and 930N shown in FIG. 14.

Antenna polarization may be described as the orientation (both amplitude and phase components) of the E-field as it propagates through free space. This particular embodiment of a polarizer 230 synthesizes circular polarization, both right-hand (RHCP) and left-hand (LHCP). Circular polarization looks like a rotating wave that rotates with either right-hand or left-hand. These fields are orthogonal and will not interact with one another in free space. Circular polarization is achieved by adding the linear H and V components together with a 90° phase offset between them.

Figure 15A:
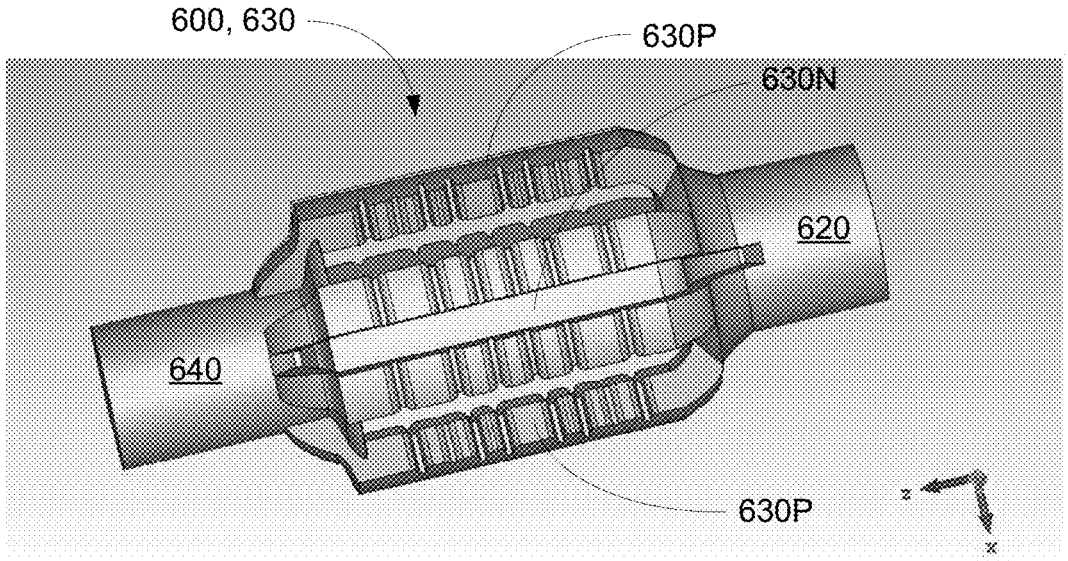
FIGS. 15A and 15B are a perspective and cross-sectional views of the combined geometric volume of a coaxial section (right side) transitioning into polarizer arms (center) then transitioning into circular waveguide (left side), according to an embodiment of the present invention.

FIG. 15A is another perspective view of the antenna feed air volume 600 as shown in FIG. 10. The combined geometry of a coaxial waveguide section 620 (right side) transitioning into polarizer arms or branches 630N and 630P (center) further transitioning into circular waveguide input 240 (left side). Coaxial waveguide section 620 represents a truncated portion of a coaxial feed horn 620 (less the outer horn conductor or bell 370, see FIG. 8). Antenna feed air volume 600 represents all of the geometry necessary to convert a linearly polarized (H or V) input in the circular waveguide 240 into a circularly polarized (RHCP or LHCP) output in the coaxial waveguide section 620. Due to reciprocity, a linearly polarized (H or V) input to the coaxial region will also produce a circularly polarized (RHCP or LHCP) output at the circular region. The linear polarization H or V wave at either end of the polarizer 230 needs to be oriented at a 45° rotated angle with respect to the waveguide branches 730P and 730N. This way the power splits equally between both sets of branches 730P and 730N.

Figure 15B:
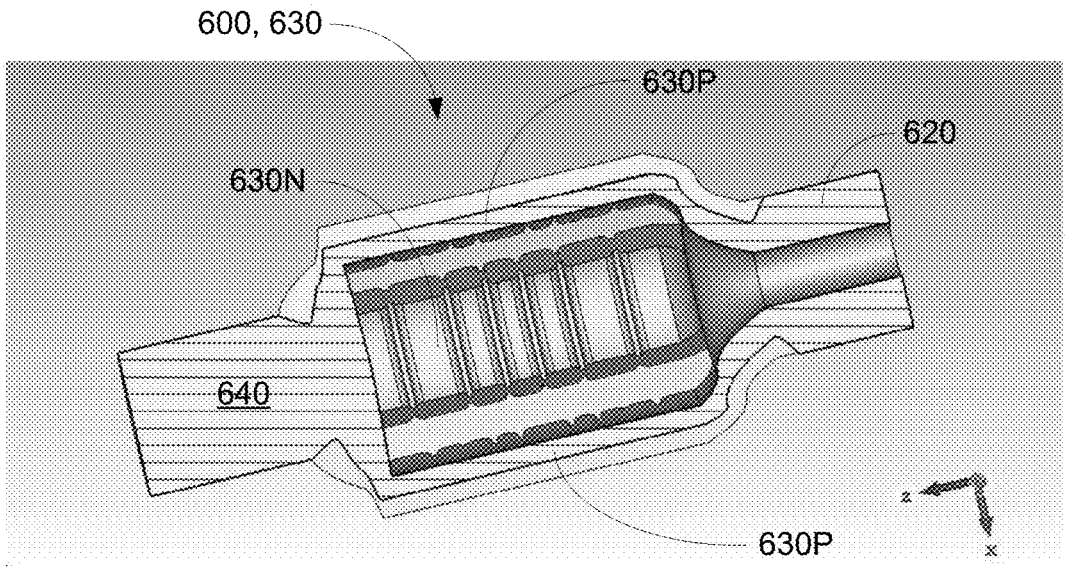

FIG. 15B illustrates a cross-section of combined geometry of antenna feed air volume 600 shown in FIGS. 10 and 15A. More particularly, FIG. 15B illustrates coaxial waveguide section 620 (right side) the polarizer air volume 630 (center) then transitioning into circular waveguide input 640 (left side). The cross-section in FIG. 15B passes through the positive phase-shift branch air volumes 630P (center top and bottom) of the polarizer air volume 630. One of the negative phase-shift branch air volumes 630N (center) of the polarizer air volume 630 is also shown in FIG. 15B. Note that the opposed negative phase-shift branch air volume 630N is not visible due to the cut-plane of the FIG. 15B. FIG. 15B also more clearly shows the coaxial waveguide section 620 on the right side and the circular waveguide input 640 on the left side.

FIGS. 15A and 15B are a perspective and cross-sectional views of the combined geometric volume of a coaxial section (right side) transitioning into polarizer arms (center)

then transitioning into circular waveguide (left side), according to an embodiment of the present invention. This is an air geometry that is the internal features of the metal antenna feed. The whole section represents all of the geometry necessary to convert a linearly polarized (H or V) input in the circular waveguide into a circularly polarized (RHCP or LHCP) output in the coaxial region. Due to reciprocity, a linearly polarized (H or V) input to the coaxial region will also produce a circularly polarized (RHCP or LHCP) output at the circular region. The cross-sectional view shown in FIG. 10B more clearly shows the coaxial waveguide on the right side and the circular waveguide on the left side.

Figure 16:
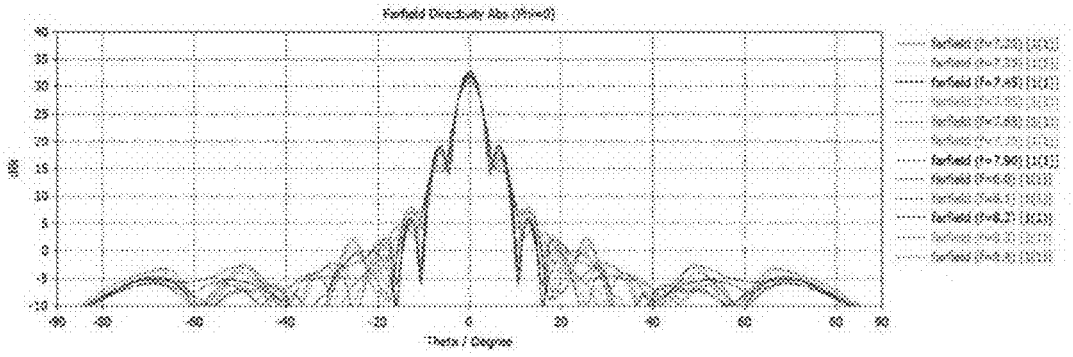
FIG. 16 is a graph of simulated performance characteristics of an embodiment of an SATCOM antenna including an embodiment of the antenna feed disclosed herein in combination with a parabolic ring-focus main reflector dish, according to the present invention.

FIG. 16 is a graph of simulated performance characteristics of an embodiment of an SATCOM antenna 100 including the antenna feed 200, 400 as detailed herein in combination with a parabolic ring-focus main reflector dish 102, according to the present invention. More particularly, FIG. 16 illustrates farfield antenna pattern directivity as a function of decibels referenced to a circularly polarized, theoretical isotropic radiator (dbiC) and degrees.

Figure 17:
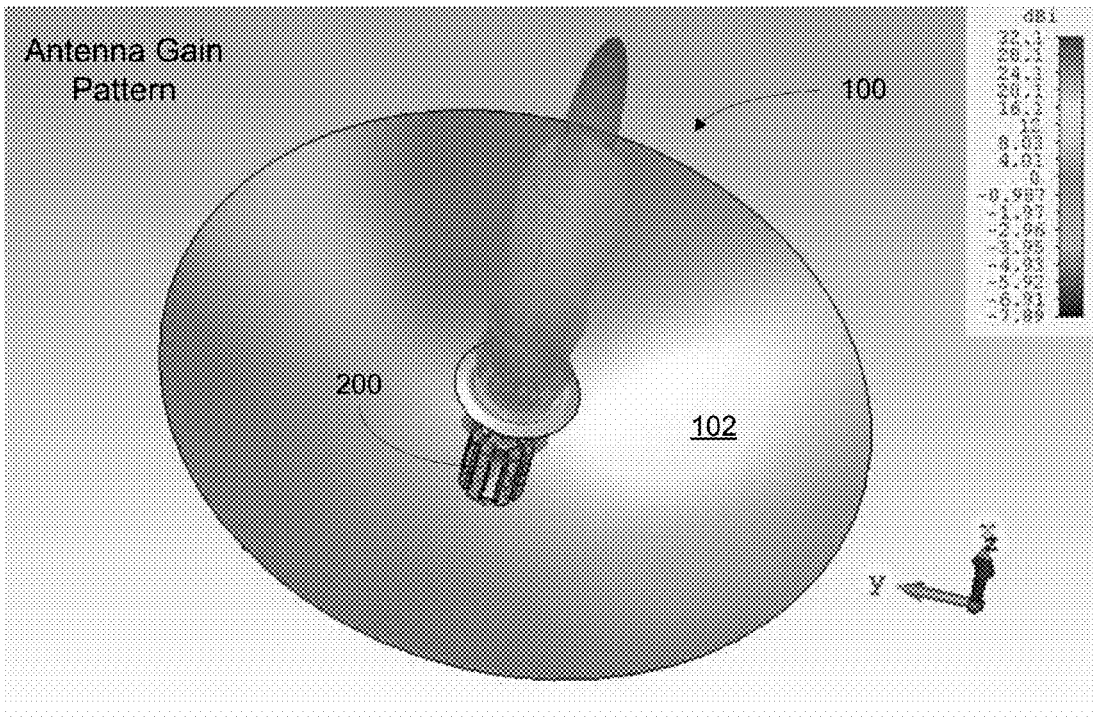
FIG. 17 is another perspective view of an embodiment of a SATCOM antenna with a composite graphical simulation of the antenna gain pattern information represented in FIG. 16, according to the present invention.

FIG. 17 is another perspective view of an embodiment of a SATCOM antenna 100 with a composite graphical simulation of the farfield antenna pattern directivity component at a single frequency, according to the present invention. As shown in FIG. 17, antenna 100 may include antenna feed 200 (as shown, or alternatively antenna feed 400) mounted to a parabolic ring-focus main reflector dish 102. The performance characteristics shown in the graph of FIG. 16 are illustrated in 3D in the color composite of FIG. 17.

High Gain Antenna

The main reflector dish 102 focuses energy to its ring focus 104 (hidden by subreflector 210, but see, e.g., FIG. 2). Energy at the ring focus 104 is directed into the antenna feed 200 (receiving) or out of the antenna feed 200 (transmitting) by the interaction between the subreflector 210 (see FIGS. 2-4 and related discussion above) and coaxial feed horn 220 (also see FIGS. 2-4 and related discussion above). It should be noted that receive and transmit performance are identical in a passive radio frequency (RF) system, such as SATCOM antenna 100. The antenna feed 200 synthesizes the necessary polarization (orientation of the electric field) and converts the energy into a set of inputs. In this particular embodiment, there are two polarizations supported by antenna feed 200 (and embodiment 400, see FIG. 4 and related discussion above). Those polarizations are RHCP and LHCP. The polarizer 230 of the antenna feed 200 is the component that is specifically designed to synthesize the RHCP and LHCP polarizations.

Main Parabolic Ring-Focus Reflector Dish to Subreflector

Figure 18:
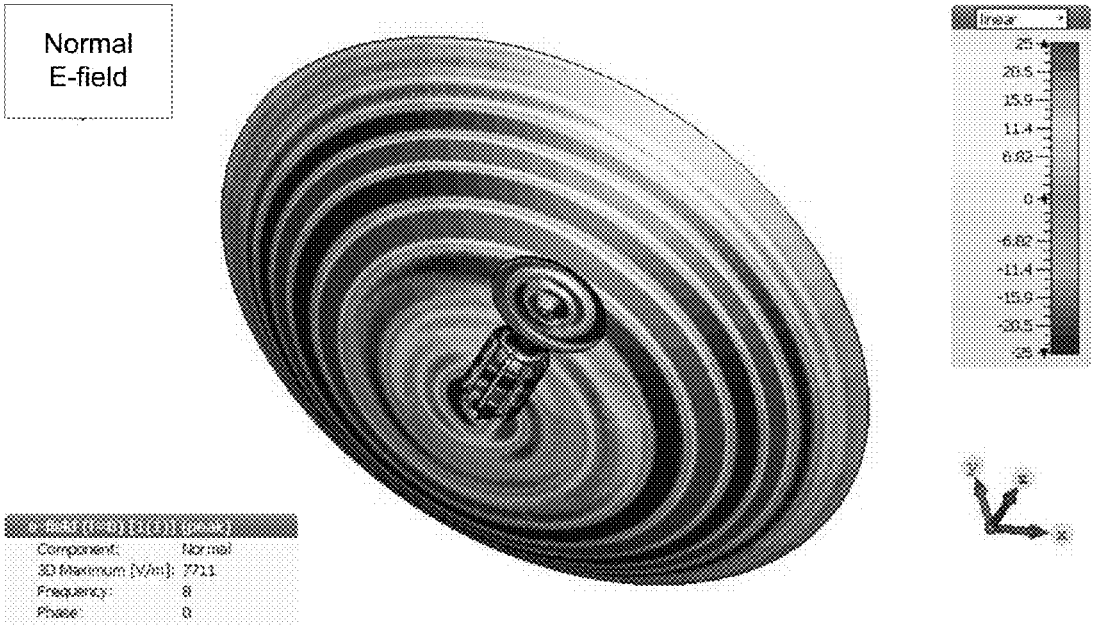
FIG. 18 is perspective view of an embodiment of a SATCOM antenna including an embodiment of an integrated single-piece antenna feed illustrating a color composite simulation of the normal electric field component, according to the present invention.

FIG. 18 is perspective view of an embodiment of a SATCOM antenna 100 including an embodiment of an integrated single-piece antenna feed 200 illustrating a color composite simulation of the normal electric field (E-field) component, according to the present invention. The parabolic ring-focus main reflector dish 102 focuses energy to the subreflector 210, which in turn reflects the energy to the coaxial feed horn 220 of the antenna feed 200. A particularly useful and novel feature is that the subreflector is supported as part of the coaxial feed horn. The coaxial feed horn utilizes the $TE_{11}$ mode.

Figure 19:
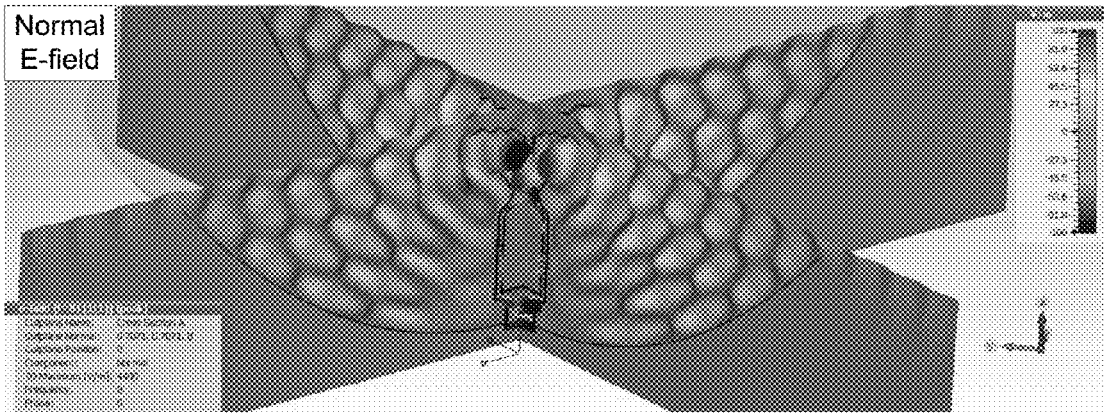
FIGS. 19-23 are various color composite plots of normal and absolute E-fields for a SATCOM antenna including an embodiment of an integrated single-piece antenna feed, according to the present invention.
Figure 20:
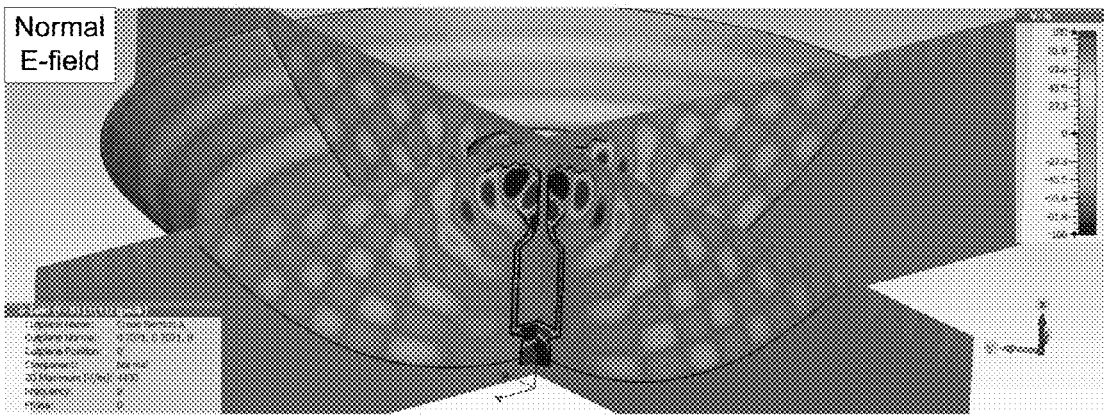
Figure 21:
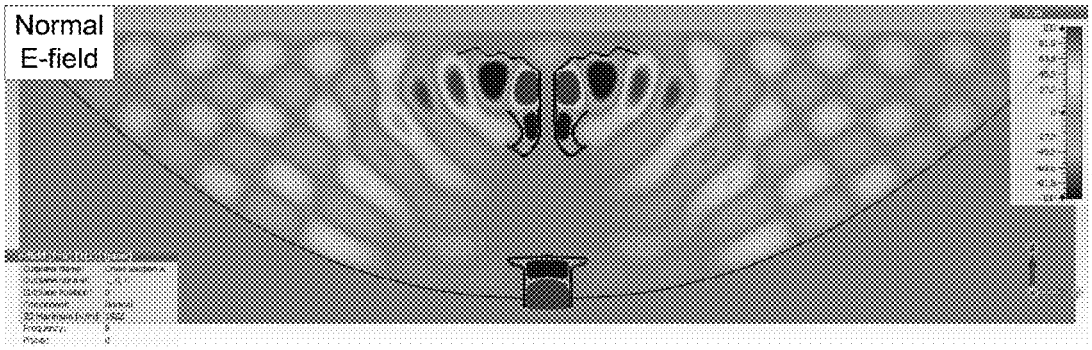
Figure 22:
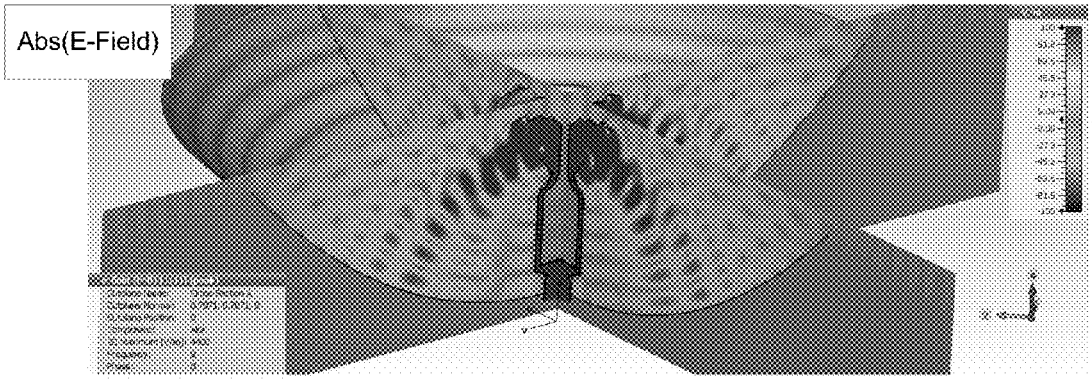
Figure 23:
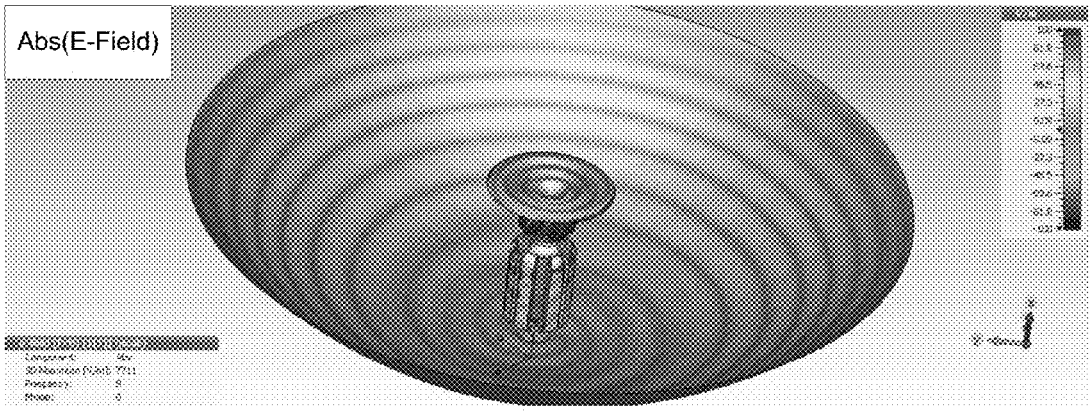

FIGS. 19-23 are various color composite plots of normal and absolute E-fields for a SATCOM antenna 100 including an embodiment of an integrated single-piece antenna feed 200, according to the present invention. E-fields labelled "Normal" (FIGS. 18-21) imply the electric field component shown is normal to the surface or cut plane on which they are painted. More particularly, FIGS. 19 and 20 depict the energy being focused from the coaxial feed horn 220 to the subreflector 210 and then to the main reflector 102. These plots show identical information, but FIG. 19 adds a depth dimension to the Normal E-field component to represent the vector orientation of the Normal E-field component. FIG. 21 shows a side cut plane oriented at 0° with respect to the rotation axis of the reflector of the Normal E-field. This further shows the illumination of the main reflector 102 due to the subreflector 210 and coaxial feed horn 220. The color of the Normal E-field plot denotes whether the vector orientation of the field is going into (blue) or coming out of (red) the plane. This shows the phase relationship of the E-field. Note that in plots showing only the "Normal" E-field component, there is a "Tangential" component which is not shown in the plot and is oriented parallel to the surface containing the E-field plot. Whereas E-fields labelled "Abs (E-Field)" (FIGS. 22 and 23) imply that the magnitude of all electric fields (tangential and normal) are being shown. FIGS. 22 and 23 illustrate the absolute E-fields as a color gradient from green (no field) to red (max field). FIGS. 22 and 23 illustrate the intensity of all fields in a given area. FIG. 23 shows the illumination of the main reflector 102 by the subreflector 210 and coaxial feedhorn 220, similar to FIGS. 19 and 20, but with the total E-field.

Subreflector to Coaxial Feed Horn

Figure 24:
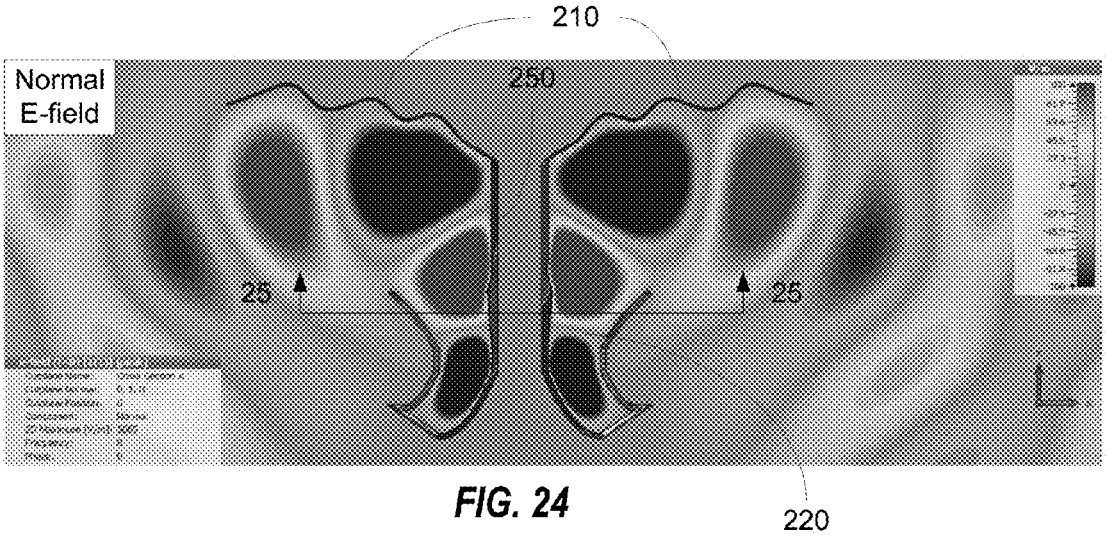
FIG. 24 is a color composite plot of the normal E-Field through a cross-section of a subreflector and coaxial feed horn of an embodiment of the integrated single-piece antenna feed, according to the present invention.

FIG. 24 is a color composite plot of the normal E-Field through a cross-section of a subreflector and coaxial feed horn of an embodiment of the integrated single-piece antenna feed, according to the present invention. During transmitting (Tx), radiation emanating from the coaxial feed horn 220 is reflected off the subreflector 210 supported by the subreflector support 250. During receiving (Rx), radiation from the main reflector 102 (not shown, but see FIGS. 1-2) is focused into the subreflector 210 and then focused back down through the coaxial feed horn 220. Stated another way, the subreflector 210 focuses the energy from the parabolic main reflector dish 102 (not shown) into the coaxial feed horn 220

Figure 25:
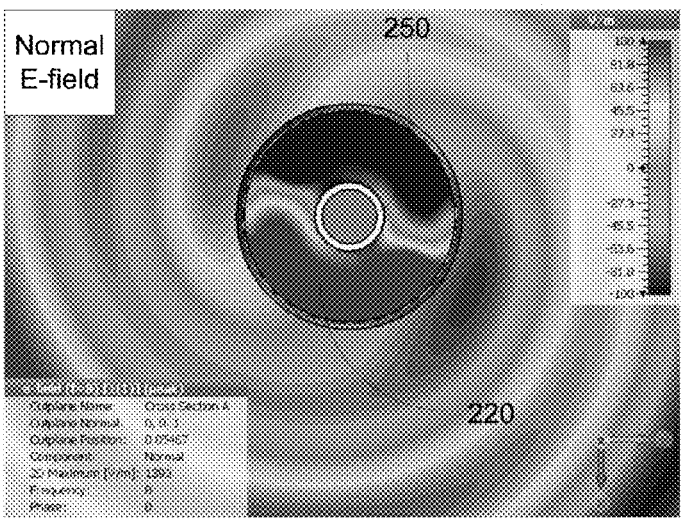
FIG. 25 is a color composite plot of the rotating normal E-field as seen through a cross-section through the coaxial feed horn shown in FIG. 24.

FIG. 25 is a color composite plot of the rotating normal E-field as seen through a cross-section through the coaxial feed horn 220 shown in FIG. 24. As shown in FIG. 25 the normal E-fields for a spiral shape due to being circularly polarized by the polarizer (not shown, but see, e.g., FIGS. 2-4). The coaxial feed horn 220 provides the interface between the polarizer 230 (not shown) and the subreflector 210.

Figure 26:
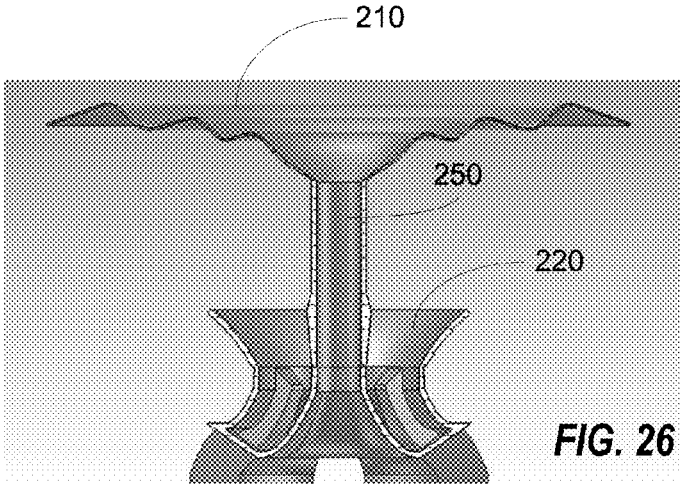
FIG. 26 is a cross-section through the subreflector, subreflector support and coaxial feed horn of an embodiment of an integrated antenna feed, according to the present invention.

FIG. 26 is a cross-section through the subreflector, subreflector support and coaxial feed horn of an embodiment of an integrated antenna feed, according to the present invention. The subreflector 210 is supported by subreflector support 250 which are printed through an additive metal manufacturing process. According to one embodiment, the subreflector 210 may include an optimized geometry that allows for improved efficiency and sidelobe performance.

Figure 27:
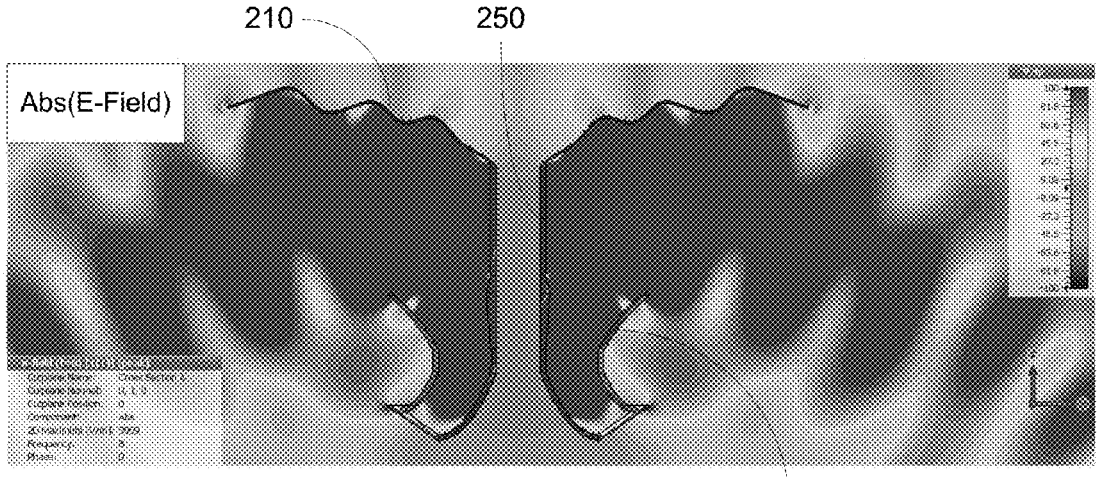
FIG. 27 is a color composite plot of the absolute E-field in the free space between the subreflector, subreflector support and coaxial feed horn of an embodiment of an integrated antenna feed, according to the present invention.

FIG. 27 is a color composite plot of the absolute E-field in the free space between the subreflector, subreflector support and coaxial feed horn of an embodiment of an integrated antenna feed, according to the present invention. As can be seen by the red portion of the color composite plot, the maximum absolute E-field power is directed in the free space between the subreflector 210 and the coaxial feed horn 220.

Polarizer and Circular Polarization

Figure 28:
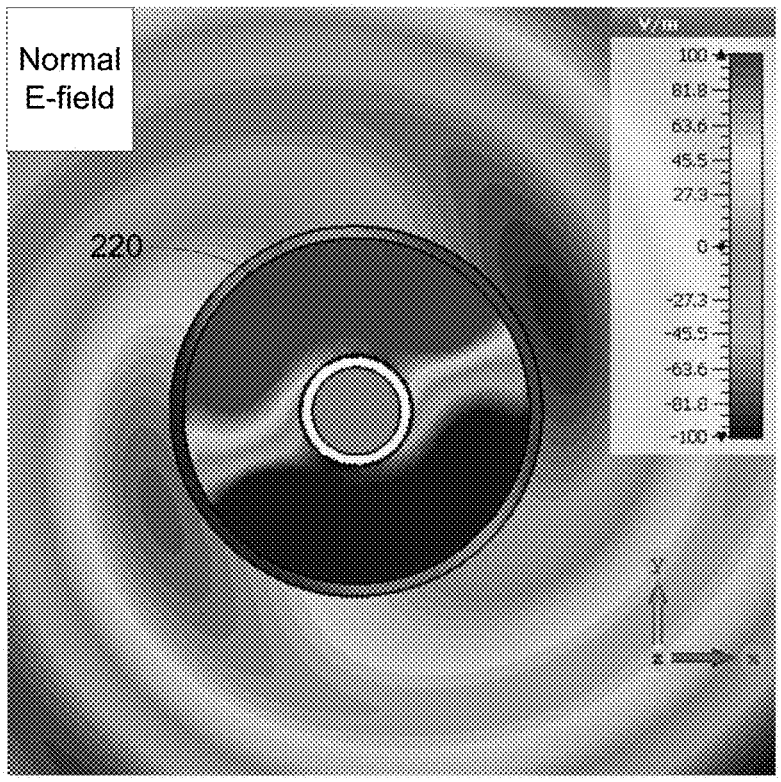
FIGS. 28 and 29 are color composite plots illustrating LHCP and RHCP, respectively about the cross-section of an embodiment of a coaxial feed horn, according to the present invention.
Figure 29:
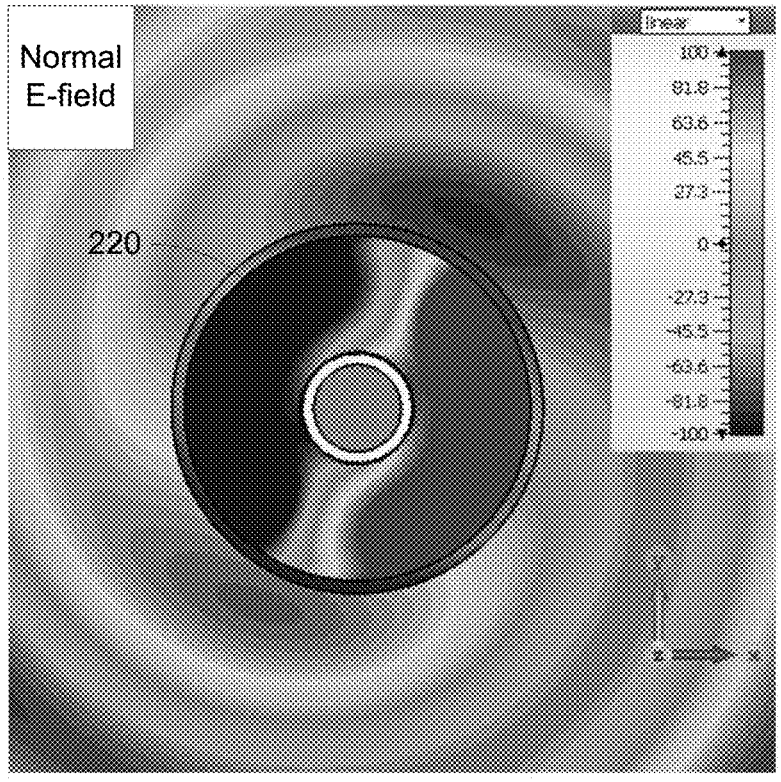

FIGS. 28 and 29 are color composite plots illustrating LHCP and RHCP, respectively about the cross-section of an embodiment of a coaxial feed horn, according to the present invention. Circular polarization looks like a rotating wave that rotates either right-hand or left-hand, as can be seen in the spiral orientation of the E-field. These E-fields are orthogonal and will not interact with one another in free space. Circular polarization is achieved by adding the linear H and V field components together with a 90° phase offset between them. The right hand and left hand polarizations differ by which component (H or V) is offset by 90°.

Figure 31:
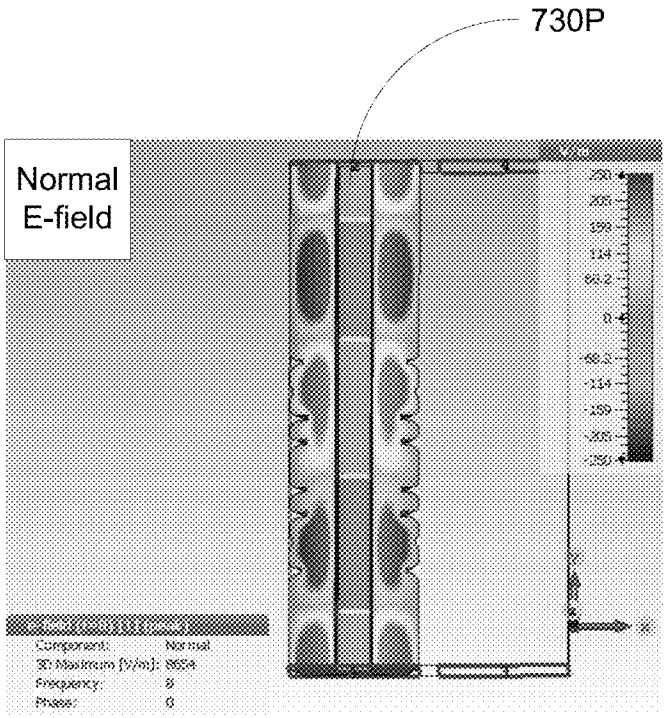
FIGS. 30 and 31 are color composite plots illustrating the 90° phase-shift between a given negative phase-shift waveguide branch relative to one of the positive phase-shift waveguide branches, respectively, of an embodiment of a polarizer, according to the present invention.
Figure 30:
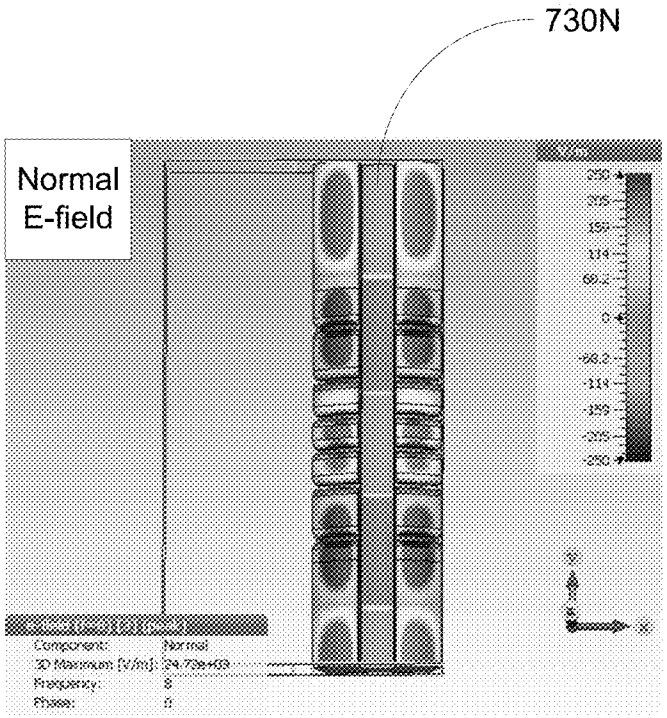

FIGS. 30 and 31 are color composite plots illustrating the 90° phase-shift between a given negative phase-shift waveguide branch 730N relative to one of the positive phase-shift waveguide branches 730P, respectively, of an embodiment of a polarizer 230, according to the present invention. Note that the colored wave in the positive branch 730P (FIG. 31) is advanced upward with respect to the negative branch 730N (FIG. 30). The relative phase-shift is 90° or ¼ wave. Note that a full wave spans a red and blue blob in either FIG. 30 or FIG. 31. The phase shift difference can also be seen by counting the number of full waves travelling through the waveguide, where in FIG. 30 there are approximately 2.25 full waves and in FIG. 31 there are approximately 2 full waves.

Figure 32:
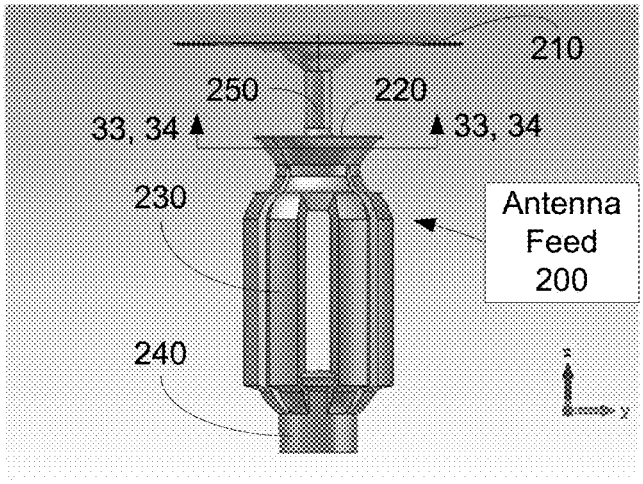
FIG. 32 is another side view of an embodiment of the integrated antenna feed showing the location of the cross-section shown in FIGS. 33 and 34.
Figure 33:
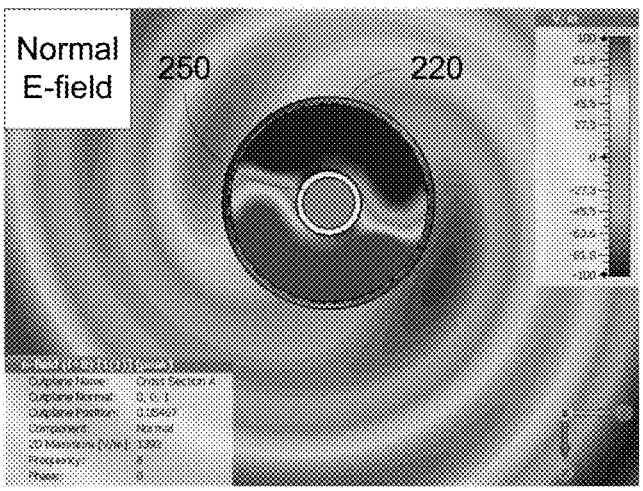
FIG. 33 is another color composite plot illustrating circular polarization of the E-field through and around a cross-section of an embodiment of a coaxial feed horn, according to the present invention.
Figure 34:
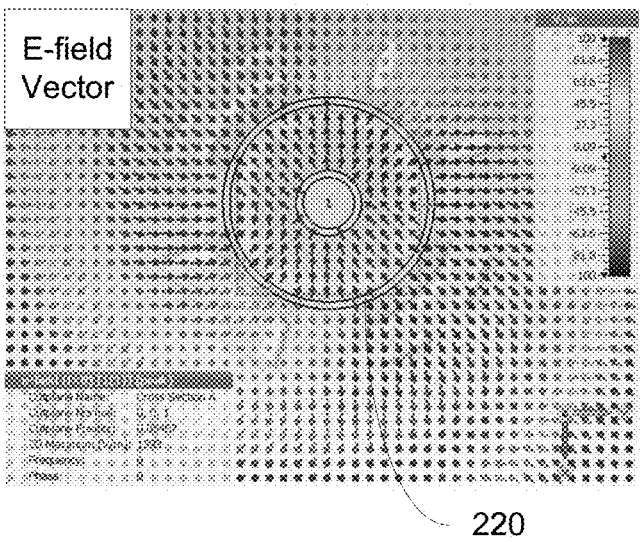
FIG. 34 is an E-field vector representation of the circular polarization of the E-field through a cross-section of an embodiment of a coaxial feed horn shown in FIGS. 32 and 33, according to the present invention.

FIG. 32 is another side view of an embodiment of the integrated antenna feed 200 showing the location of the cross-section shown in FIGS. 33 and 34. More particularly, FIG. 32 illustrates from top to bottom a subreflector 210, subreflector support 250, coaxial feed horn 220, polarizer 230 and circular waveguide input 240.

FIG. 33 is another color composite plot illustrating circular polarization of the E-field through a cross-section of an embodiment of a coaxial feed horn 220, according to the present invention. More particularly, FIG. 33 illustrates RHCP of the normal E-field at the cross-section through the coaxial feed horn 220 shown in FIG. 32. This can be seen through the spiral fields external to the coaxial feed horn 220.

FIG. 34 is an E-field vector representation of the RHCP of the E-field through and around a cross-section of an embodiment of a coaxial feed horn 220, according to the present invention. The arrows in FIG. 34 indicate the direction of the E-field as it propagates through and around a coaxial feed horn 220. The arrows inside the coaxial feed horn 220 are primarily aligned as a $TE_{11}$ mode.

Figure 35:
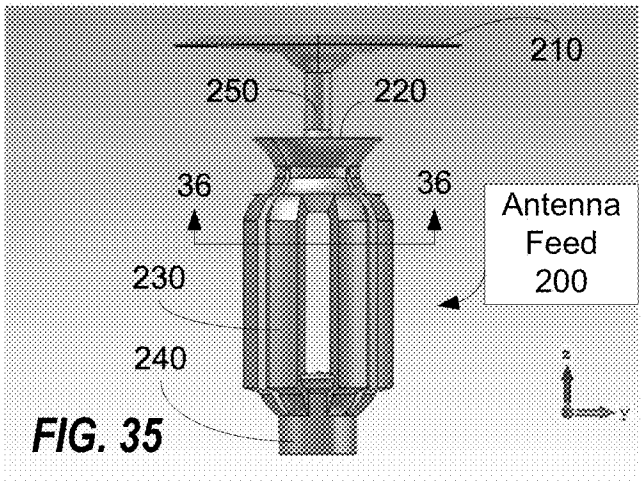
FIG. 35 is another side view of an embodiment of the integrated antenna feed showing the location of the cross-section shown in FIG. 36.
Figure 36:
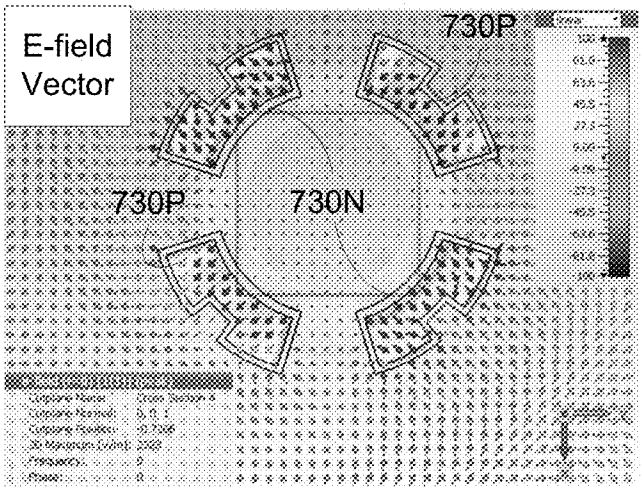
FIG. 36 is a color composite plot illustrating the normal E-fields within and around the negative and positive phase-shift branches of the polarizer at the cut-plane indicated on FIG. 35, according to the present invention.

FIG. 35 is another side view of an embodiment of the integrated antenna feed showing the location of the cross-section shown in FIG. 36, near the top of the polarizer 230. FIG. 35 also illustrates from top to bottom a subreflector 210, subreflector support 250, coaxial feed horn 220, polarizer 230 and circular waveguide input 240.

FIG. 36 is an E-Field vector representation of the E-field through a cross-section of an embodiment of the polarizer shown in FIG. 35, according to the present invention. The arrows in FIG. 36 indicate the direction of the E-field as it propagates through and around the top of the polarizer 230 shown in cross-section. The arrows inside the wrapped-single-ridged waveguide branches 730N and 730P can be seen to primarily align with a $TE_{10}$ mode.

Figure 37:
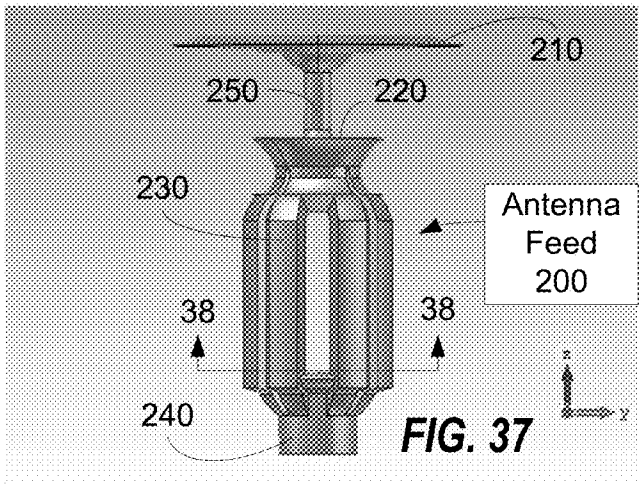
FIG. 37 is another side view of an embodiment of the integrated antenna feed showing the location of the cross-section shown in FIG. 38, near the bottom of the polarizer.
Figure 38:
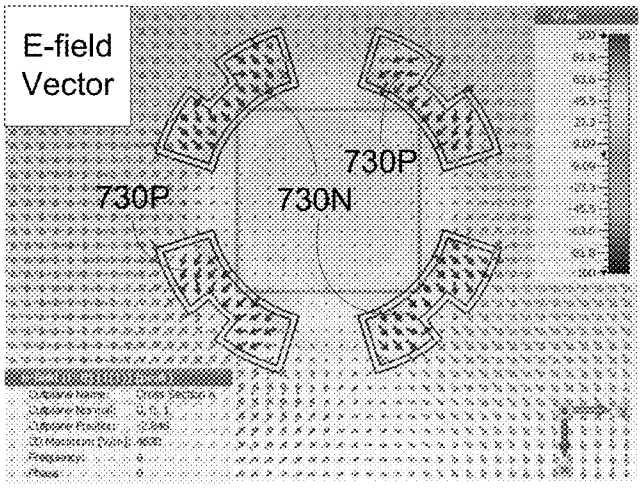
FIG. 38 is an E-field vector representation of the E-field through a cross-section of an embodiment of the polarizer shown in FIG. 37, according to the present invention.

FIG. 37 is another side view of an embodiment of the integrated antenna feed showing the location of the cross-section shown in FIG. 38, near the bottom of the polarizer 230. FIG. 37 also illustrates from top to bottom a subreflector 210, subreflector support 250, coaxial feed horn 220, polarizer 230 and circular waveguide input 240.

FIG. 38 is an E-field vector representation of the E-field through a cross-section of an embodiment of the polarizer shown in FIG. 37, according to the present invention. The arrows in FIG. 38 indicate the direction of the E-field as it propagates through and around the bottom of the polarizer 230 shown in cross-section. The arrows inside the wrapped-single-ridged waveguide branches 730N and 730P can be seen to primarily align with a $TE_{10}$ mode.

Figure 39:
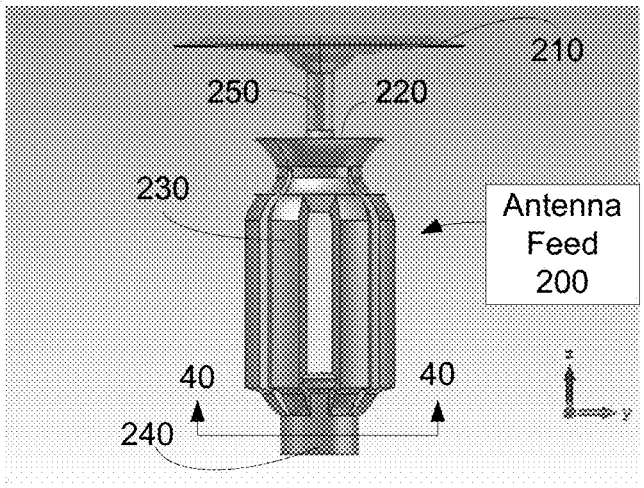
FIG. 39 is another side view of an embodiment of the integrated antenna feed showing the location of the cross-section shown in FIG. 40, through the circular waveguide input.
Figure 40:
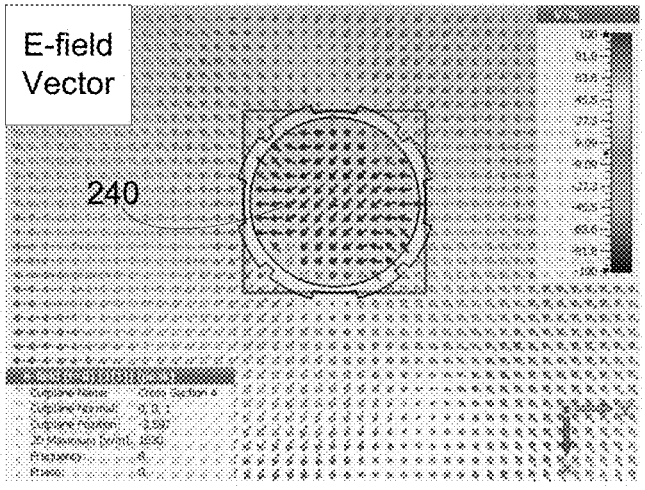
FIG. 40 is an E-field vector representation of the E-field through and around a cross-section of an embodiment of the circular waveguide input shown in FIG. 39.

FIG. 39 is another side view of an embodiment of the integrated antenna feed showing the location of the cross-section shown in FIG. 40, through the circular waveguide input 240. FIG. 39 also illustrates from top to bottom a subreflector 210, subreflector support 250, coaxial feed horn 220, polarizer 230 and circular waveguide input 240.

FIG. 40 is an E-field vector representation of the E-field through and around a cross-section of an embodiment of the circular waveguide input 240 shown in FIG. 39. The arrows represent E-field direction as the wave propagates. The arrows inside the circular waveguide 240 can be seen to primarily align with a $TE_{11}$ mode that is oriented 45° with respect to the rotation axis of the reflector.

Having described the various embodiments of an integrated single-piece antenna feed and their various components in reference to the drawing FIGS., some general embodiments will now be disclosed. For example, an embodiment of an integrated single-piece antenna feed 200, 400 having an axis 300 with proximal 280 and distal 290 ends for propagating an electromagnetic wave is disclosed. The antenna feed 200 may include a circular waveguide input 240 having a circular opening 242 at the proximal end 280 that extends coaxially toward the distal end 290. The antenna feed 200 may further include a circular waveguide to wrapped-single-ridged waveguide transition 260 coupled to the circular waveguide input 240 extending further along the axis 300 toward the distal end 290 and flaring radially outward relative to the axis 300 into four waveguide branches. The antenna feed 200, 400 may further include a polarizer 230 coupled to the four branches of the circular waveguide to wrapped-single-ridged waveguide transition 260, wherein each of the four branches forms a wrapped-single-ridged waveguide 730P and 730N extending from the circular waveguide to wrapped-single-ridged waveguide transition 260 and parallel to the axis 300 further toward the distal end 290. The antenna feed 200 may further include a wrapped-single-ridged waveguide to coaxial waveguide transition 270 coupled to the polarizer 230 wherein each of the four branches 730P and 730N transitions into a single coaxial waveguide. The single coaxial waveguide may be located at the throat of the coaxial feed horn 220, according to one embodiment of the present invention. The antenna feed 200 may further include a coaxial feed horn 220 coupled to the single coaxial waveguide of the wrapped-single-ridged to coaxial waveguide transition 270, the single coaxial waveguide disposed between an inner conductor of the coaxial feed horn 220 that is also a cylindrical subreflector support 250 having a smaller diameter and an outer horn conductor 370, or feed horn bell, having a larger and variably increasing diameter opening to free space. The cylindrical subreflector support 250 extends coaxially from the coaxial feed horn 220 still further toward the distal end 290. The antenna feed 200, 400 may further include a subreflector 210 located at the distal end 290 and supported by the cylindrical subreflector support 250.

According to another embodiment of the integrated single-piece antenna feed 200, 400, the circular waveguide input may further include a flange 450 disposed around the circular opening 442 at the proximal end 280. The flange 450 may further include a plurality of mounting holes 460 suitable for mounting the integrated single-piece antenna feed 400 to a main reflector 102 of an antenna system 100.

According to yet another embodiment of the integrated single-piece antenna feed 200, 400, the power of an electromagnetic signal propagating from the circular waveguide input 240 is split equally into all four of the branches 730P and 730N of the polarizer 230. According to still another embodiment of the integrated single-piece antenna feed 200, 400, each of the four branches 730P and 730N of the polarizer 230 is equally-spaced around and parallel to the axis 300.

According to still yet another embodiment of the integrated single-piece antenna feed 200, 400, two of the four branches of the polarizer 230 are positive phase-shift waveguide branches 730P, each having a +45° phase-shift and disposed opposite one another relative to the axis 300. According to this same embodiment, the two remaining of the four branches of the polarizer 230 are negative phase-shift waveguide branches 730N, each have a −45° phase-shift. According to this same embodiment, when all four branches 730P and 730N are recombined at the coaxial feed horn 220, recombined power of a wave propagating through the polarizer 230 produces a necessary 90° phase-shift between two equal amplitude linear components of the wave necessary to synthesize right-hand circular polarization (RHCP) and left-hand circular polarization (LHCP).

According to another embodiment of the integrated single-piece antenna feed 200, each of the positive phase-shift waveguide branches 730P comprises a waveguide having a floor 644 closer to the axis 300, a ceiling 642 further from the axis 300 and two opposed walls 648, each wall 648 extending from floor 644 to ceiling 642. The embodiment of the integrated antenna feed 200, 400 may further include a plurality of floor 644 to ceiling 642 rib pairs 660, 662, 664 extending from the opposed walls 648 toward each other for achieving a +45° phase-shift in an electromagnetic wave propagating through the positive phase-shift waveguide branch 730P. According to yet another embodiment of the integrated single-piece antenna feed 200, 400, the plurality of floor 644 to ceiling 642 rib pairs 660, 662, 664 extending from the opposed walls 648 comprises eight rib pairs 660, 662, 664.

According to yet another embodiment of the integrated single-piece antenna feed 200, 400, each of the negative phase-shift waveguide branches 730N comprises a waveguide having a floor 634 closer to the axis 300, a ceiling 632 further from the axis 300 and two opposed walls 638, each of the walls 638 extending from the floor 634 to the ceiling 632. The embodiment of the integrated single-piece antenna feed 200 may further include a plurality of wall 638 to opposed wall 638 rib pairs 650, 652, 654 extending toward each other from the ceiling 632 and the floor 634 configured for achieving a −45° phase-shift in an electromagnetic wave propagating through the negative phase-shift waveguide branch 730N. According to still another embodiment of the integrated single-piece antenna feed 200, 400, the plurality of wall 638 to opposed wall 638 rib pairs 650, 652, 654 extending from the ceiling 632 and the floor 634 comprises eight rib pairs 650, 652, 654.

According to another embodiment of the integrated single-piece antenna feed 200, 400, each of the four branches 730P and 730N of the polarizer 230 comprises a waveguide having a floor 634, 644 extending between the proximal 280 and distal 290 ends and parallel to the axis 300, a ceiling 632, 642 extending between the proximal 280 and distal 290 ends. According to this embodiment, the ceiling 632, 642 may also extend parallel to, and further away from, the axis 300 than the floor 634, 644. This embodiment may further include two opposed walls 638, 648 extending from the floor 634, 644 to the ceiling 632, 642. This embodiment may further include a ridge 636, 646 extending perpendicularly from the ceiling 632, 642 toward the axis 300, effectively bisecting the ceiling 632, 642. According to this embodiment of the integrated single-piece antenna feed 200, 400, the ridge 636, 646 may also extend between the proximal 280 and distal ends 290 parallel to the axis 300.

According to another embodiment of the integrated single-piece antenna feed 200, 400, the modes of electromagnetic wave transmission propagating through the circular waveguide input 240, 440 comprise two orthogonal $TE_{11}$ modes rotated 90° apart from each other. According to yet another embodiment of the integrated single-piece antenna feed 200, 400, the only mode of electromagnetic wave transmission propagating through the polarizer 230 comprises $TE_{10}$ mode. According to still another embodiment of the integrated single-piece antenna feed 200, 400, the only mode of electromagnetic wave transmission propagating through a throat of the coaxial feed horn 220 comprises $TE_{11}$ mode.

According to another embodiment of the integrated single-piece antenna feed 200, 400, the subreflector 210 comprises a circularly symmetric optimized subreflector 210. According to yet another embodiment of the integrated single-piece antenna feed 200, 400, the cylindrical subreflector support 250 comprises a center conductor 250 of the coaxial feed horn 220.

According to another embodiment of the integrated single-piece antenna feed 200, 400, the four wrapped-single-ridged waveguide branches 730P and 730N of the polarizer 230 comprise internal ribs 650, 652, 654, 660, 662 and 664 for generating a circularly polarized output wave from a linearly polarized input wave. According to yet another embodiment of the integrated single-piece antenna feed 200, 400, the antenna feed is formed of a single-piece of metal that cannot be disassembled into its component parts. According to yet another embodiment of the integrated single-piece antenna feed 200, 400, the antenna feed 200, 400 may be manufactured as a single-piece of aluminum using three-dimensional additive metal printing techniques.

According to still another embodiment of the integrated single-piece antenna feed 400, the circular waveguide input 440 may be mounted to an apex 106 of a ring-focus main reflector 102 having a focal length, F, for generating a ring focus 104 within open space between the bell 370 of the coaxial feed horn 220 and the subreflector 210.

An embodiment of a turnstile polarizer 230 disposed between an embodiment of a circular waveguide input 240, 440 and an embodiment of a coaxial feed horn 220 is disclosed. The embodiment of a polarizer 230 may include two wrapped-single-ridged positive phase-shift waveguides 730P. Each positive phase-shift waveguide 730P may have a first and a second end. The embodiment of a polarizer 230 may further include two wrapped-single-ridged negative phase-shift waveguides 730N, each negative phase-shift waveguide 730N having opposite ends (which may be referenced as third and fourth ends in the claims). The embodiment of a polarizer 230 may further include a first transition 260 in communication with the circular waveguide input 240, 440 and the first ends of the two wrapped-single-ridged positive phase-shift waveguides 730P, the first transition 260 also in communication with the third ends of the two wrapped-single-ridged negative phase-shift waveguides 730N. The embodiment of a polarizer 230 may further include a second transition 270 in communication with the coaxial feed horn 230 and the second ends of the two wrapped-single-ridged positive phase-shift waveguides 730P, the second transition 270 also in communication with the fourth ends of the two wrapped-single-ridged negative phase-shift waveguides 730N.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "top, bottom, forward, rearward, above, downward, vertical, horizontal, below and transverse" as well as any other similar directional terms refer to those directions of an embodiment of an integrated single-piece antenna feed 200, 400, as oriented in a given FIG. The terms "air volume" 630P, 630N and "waveguide cavity" 630P, 630N are used synonymously herein in reference to the interior space of its associated "waveguide branch" 730P, 730N. Finally, terms of degree such as "substantially", "about" and "approximately" as used herein mean a reasonable amount of deviation of the modified term such that the end result is not significantly changed.

It will further be understood that the present invention may suitably comprise, consist of, or consist essentially of the component parts, method steps and limitations disclosed herein. However, the invention illustratively disclosed herein suitably may be practiced in the absence of any element which is not specifically disclosed herein.

While the foregoing advantages of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. An integrated single-piece antenna feed having an axis with proximal and distal ends for propagating an electromagnetic wave, comprising:

a circular waveguide input having a circular opening at the proximal end and extending coaxially toward the distal end;

a circular waveguide to wrapped-single-ridged waveguide transition coupled to the circular waveguide input extending further along the axis toward the distal end and flaring radially outward relative to the axis into four waveguide branches;

a wrapped-single-ridged waveguide to coaxial waveguide transition coupled to the circular waveguide to wrapped-single-ridged waveguide transition wherein each of the four branches transitions into a single coaxial waveguide;

a coaxial feed horn coupled to the single coaxial waveguide of the wrapped-single-ridged to coaxial waveguide transition, the single coaxial waveguide disposed between a cylindrical subreflector support and an outer feed horn conductor, the cylindrical subreflector support extending coaxially from the feed horn still further toward the distal end; and a subreflector located at the distal end and supported by the cylindrical subreflector support.

2. The integrated single-piece antenna feed according to claim 1, wherein the circular waveguide input further comprises a flange disposed around the circular opening at the proximal end, the flange further comprising a plurality of mounting holes suitable for mounting the integrated antenna feed to a main reflector of an antenna system.

3. The integrated single-piece antenna feed according to claim 1, wherein the power of an electromagnetic signal propagating from the circular waveguide input is split equally into the four waveguide branches.

4. The integrated single-piece antenna feed according to claim 1, wherein each of the four waveguide branches is equally-spaced around and parallel to the axis.

5. The integrated single-piece antenna feed according to claim 1, wherein the subreflector comprises a circularly symmetric optimized subreflector.

6. The integrated single-piece antenna feed according to claim 1, wherein the cylindrical subreflector support comprises a center conductor of the coaxial feed horn.

7. The integrated single-piece antenna feed according to claim 1, wherein the antenna feed is formed of a single-piece of metal that cannot be disassembled into its component parts.

8. The integrated single-piece antenna feed according to claim 1, wherein the antenna feed is manufactured as a single-piece of aluminum using three-dimensional additive metal printing techniques.

9. The integrated single-piece antenna feed according to claim 1, wherein the primary mode of electromagnetic wave transmission propagation through a throat of the coaxial feed horn comprises $TE_{11}$ mode.

10. An antenna comprising:

a ring-focus main reflector having an apex;

an integrated single-piece antenna feed having an axis with proximal and distal ends for propagating an electromagnetic wave, comprising:

a circular waveguide input having a circular opening at the proximal end and extending coaxially toward the distal end, wherein the circular waveguide input is mounted to the apex of the ring-focus main reflector;

a circular waveguide to wrapped-single-ridged waveguide transition coupled to the circular waveguide input extending further along the axis toward the distal end and flaring radially outward relative to the axis into four waveguide branches;

a wrapped-single-ridged waveguide to coaxial waveguide transition coupled to the circular waveguide to wrapped-single-ridged waveguide transition wherein each of the four branches transitions into a single coaxial waveguide;

a coaxial feed horn coupled to the single coaxial waveguide of the wrapped-single-ridged to coaxial waveguide transition, the single coaxial waveguide disposed between a cylindrical subreflector support and an outer feed horn conductor, the cylindrical subreflector support extending coaxially from the feed horn still further toward the distal end; and a subreflector located at the distal end and supported by the cylindrical subreflector support; and wherein the ring-focus main reflector comprises a focal length for generating a ring focus within open space between the outer feed horn conductor and the subreflector.

11. The integrated single-piece antenna feed according to claim 10, wherein the circular waveguide input further comprises a flange disposed around the circular opening at the proximal end, the flange further comprising a plurality of mounting holes suitable for mounting the integrated antenna feed to a main reflector of an antenna system.

12. The integrated single-piece antenna feed according to claim 10, wherein the power of an electromagnetic signal propagating from the circular waveguide input is split equally into the four waveguide branches.

13. The integrated single-piece antenna feed according to claim 10, wherein each of the four waveguide branches is equally-spaced around and parallel to the axis.

14. The integrated single-piece antenna feed according to claim 10, wherein the subreflector comprises a circularly symmetric optimized subreflector.

15. The integrated single-piece antenna feed according to claim 10, wherein the cylindrical subreflector support comprises a center conductor of the coaxial feed horn.

16. The integrated single-piece antenna feed according to claim 10, wherein the antenna feed is formed of a single-piece of metal that cannot be disassembled into its component parts.

17. The integrated single-piece antenna feed according to claim 10, wherein the antenna feed is manufactured as a single-piece of aluminum using three-dimensional additive metal printing techniques.

18. A turnstile circular polarizer, comprising:

four branches of wrapped-single ridged waveguides, each of the branches oriented equidistant from an axis and at 90° intervals around the axis;

wherein two of the four branches of the polarizer are positive phase-shift waveguide branches, each having a +45° phase-shift and disposed opposite one another relative to the axis; and wherein two remaining of the four branches of the polarizer are negative phase-shift waveguide branches, each have a −45° phase-shift.

19. The polarizer according to claim 18, wherein each of the positive phase-shift waveguide branches comprises a waveguide having:

a floor closer to the axis;

a ceiling further from the axis;

two opposed walls, each extending from floor to ceiling; and a plurality of floor to ceiling rib pairs extending from the opposed walls toward each other for achieving a +45° phase-shift in an electromagnetic wave propagating through the positive phase-shift waveguide branch.

20. The polarizer according to claim 18, wherein each of the negative phase-shift waveguide branches comprises a waveguide having:

a floor closer to the axis;

a ceiling further from the axis;

two opposed walls, each of the walls extending from the floor to the ceiling; and a plurality of wall to wall rib pairs extending toward each other from the ceiling and the floor configured for achieving a −45° phase-shift in an electromagnetic wave propagating through the negative phase-shift waveguide branch.

* * * * *